US005339757A

United States Patent [19]

Nakano et al.

[11] Patent Number: 5,339,757

[45] Date of Patent: Aug. 23, 1994

[54] NEEDLE-BAR DRIVING DEVICE

[75] Inventors: Motonari Nakano; Syoichi Kunieda, both of Nagoya, Japan

[73] Assignee: Brother Kogyo Kabushiki Kaisha, Nagoya, Japan

[21] Appl. No.: 935,965

[22] Filed: Aug. 27, 1992

[30] Foreign Application Priority Data

Aug. 30, 1991 [JP] Japan ..... 3-246684

[51] Int. Cl.[5] ..... D05B 69/00; D05B 1/08

[52] U.S. Cl. ..... 112/221; 112/163

[58] Field of Search ..... 112/221, 163, 167, 155, 112/80.4, 80.42; 28/107, 113, 115

[56] References Cited

U.S. PATENT DOCUMENTS 3,653,346 4/1972 Parsons ..... 112/80.42
3,881,432 5/1975 Dodd et al. ..... 112/80.42 X
4,485,752 12/1984 Slomma et al. ..... 112/80.42 X
4,569,297 2/1986 Dusch ..... 112/221
4,580,515 4/1986 Shinoda ..... 112/221 X
4,641,591 2/1987 Draghicchio ..... 112/155
5,056,444 10/1991 Lowry et al. ..... 112/221

FOREIGN PATENT DOCUMENTS 53-8242 1/1978 Japan .
57-35675 7/1982 Japan .

*Primary Examiner*—Clifford D. Crowder
*Assistant Examiner*—Paul C. Lewis
*Attorney, Agent, or Firm*—Oliff & Berridge

[57] ABSTRACT

A needle-bar driving device of a sewing machine, for oscillating a needle bar supporting at a lower end thereof a sewing needle, in the axial direction of the needle bar, including a dead-position changing apparatus for changing at least one of an upper and a lower dead position of the needle bar.

33 Claims, 16 Drawing Sheets

NEEDLE-BAR DRIVING DEVICE

BACKGROUND OF THE INVENTION

1. Field of the Invention

The present invention relates to a needle-bar driving device of a sewing machine.

2. Related Art Statement

A sewing machine has a needle-bar driving device. When a needle bar supporting at a lower end thereof a sewing needle is oscillated in the axial direction thereof by the needle-bar driving device, the sewing needle with a needle thread penetrates a work cloth, so that a loop of the needle thread is locked with a bobbin thread to form a stitch on the work cloth.

There is known a needle-bar driving device which is capable of carrying out "skip stitching" for a pattern sewing or a basting sewing, by reducing the number of stitches formed in a unit length on a work cloth fed by a feeding device, as compared with that for normal stitching or sewing, and thereby forming lengthened stitches. An example of such a needle-bar driving device is disclosed in Japanese Patent Application laid open for opposition under Publication No. 57(1982)-35675. In the prior device, a needle bar is connected, via an engagement member and an engagement pin which are engageable with each other, with a guide bar which is oscillated in the axial direction thereof by a needle-bar crank rod. In the normal sewing, the engagement member and engagement pin are engaged with each other, so that the oscillation of the crank rod is transmitted to the needle bar via the guide bar. Consequently, the needle bar is oscillated to form stitches on a work cloth. Meanwhile, in the skip stitching, the engagement member and engagement pin are disengaged from each other, so that the needle bar is independent of the oscillation of the guide bar. Consequently, the needle bar remains stopped and held at a predetermined position, and no stitch is formed on the work cloth.

In the prior needle-bar driving device which carries out the skip stitching with the needle bar being held at a predetermined position, however, a needle thread slides through the eye of the sewing needle supported by the needle bar, when the work cloth is fed by the feeding device. There arises a problem that the work cloth is dragged by the needle thread due to the friction between the thread and the inner surfaces of the needle eye. In particular, in the event that the feeding speed of the work cloth is so high, or in the event that the needle bar is stopped at a predetermined position so distant from the work cloth, the problem is worsened.

It is possible that the skip stitching be carried out without stopping a needle bar, but by changing the lower dead position of the needle bar, i.e., position where the needle bar is nearest to a work cloth during the axial-direction oscillation thereof, to a new lower dead position where a sewing needle supported by the needle bar cannot stick in the work cloth or where the sewing needle can stick in the work cloth but cannot form a stitch on the work cloth. However, there has conventionally been no needle-bar driving device which is capable of changing the lower dead position of a needle bar.

There are some additional problems for the reason that the lower dead position of a needle bar cannot be changed by the conventional needle-bar driving devices.

First, in the event that a boring operation is performed on a work piece by utilizing a boring blade fixed to the lower end of a needle bar in place of a sewing needle, it is preferred that the depth of a cut formed in the work piece by the blade be changeable depending upon the nature and/or thickness of the work piece. This would be achieved if the lower dead position of the needle bar could be changed.

Second, in the event that a marking operation is performed on a work piece by causing a sewing needle bearing no thread to stick in the work piece to produce marks or holes as a pattern for embroidering by hand, it is preferred that the holes produced in the work cloth by the needle be not excessively large. In particular, in the case where the marking operation is performed on a work piece having a greater resistance, such as a suede, buckskin, or artificial leather, a larger amount of heat is adversely generated due to the friction between the sewing needle and the work piece. In order to reduce the heat, it has conventionally been practiced to lower the rate or speed of the marking operation. However, these problems could easily be solved by changing the lower dead position of the needle bar.

Third, the normal sewing has been carried out by oscillating a sewing needle by an unnecessarily large amplitude. In order only to form stitches on a work cloth, it is not necessary to retract the sewing needle away from the work piece by so great a distance. The upper dead position of a needle bar may be established at a considerably low position above the work cloth. On the other hand, for mounting a work cloth on a sewing machine, it is preferred to establish the upper dead position of the needle bar at a considerably high position for avoiding the interference of the sewing needle with the work cloth being mounted. Thus, the conventional needle-bar driving devices oscillate a needle bar by an unnecessarily large amplitude, resulting in producing excessively large operational noise and having no room to increase the operational speed of the devices.

SUMMARY OF THE INVENTION

It is therefore an object of the present invention to provide a needle-bar driving device which is capable of changing an upper or lower dead position of a needle bar and therefore is free of the above-indicated problems.

The above object has been achieved by the present invention, which provides a needle-bar driving device of a sewing machine, for oscillating a needle bar supporting at a lower end thereof a sewing needle, in the axial direction of the needle bar, comprising dead-position changing means for changing at least one of an upper and a lower dead position of the needle bar.

According to the principle of the present invention, it is possible to change the upper or lower dead position of the needle bar between or among two or more different positions. Alternatively, it is possible to change the upper or lower dead position of the needle bar along a continuous curve indicative of the upper or lower dead position. The former case can be regarded as special case of the later case.

The amplitude of the axial-direction oscillation of the needle bar is altered by changing at least one of the upper and lower dead positions of the needle bar. Therefore, in almost cases, the dead-position changing means can be regarded as amplitude changing means for changing the oscillation amplitude of the needle bar. However, in some cases, this is not true. For example, in the event that both the upper and lower dead positions of the needle bar are changed by the same distance in the same direction according to the principle of the present invention, the oscillation amplitude of the needle bar is not changed, but the above-indicated problems can be solved.

The needle-bar driving device in accordance with the present invention is capable of carrying out the skip stitching by changing the lower dead position of the needle bar, to a new lower dead position where the sewing needle cannot stick in the work cloth or where the sewing needle can stick in the work cloth but cannot form a stitch. The needle bar is oscillated in the axial direction thereof, but no stitch is formed on the work cloth. However, the amount of sliding of the needle thread through the eye of the sewing needle during the feeding of the work cloth can be reduced, even to zero. Thus, the present device effectively prevents the needle thread from being damaged due to the frictional heat produced when the thread slides on the inner surfaces of the needle eye, and prevents the work cloth from being dragged by the thread.

In the event that the present needle-bar driving device is used for performing a boring operation, the depth of a cut formed in a work piece can be altered depending upon the nature and/or thickness of the work piece, by changing the lower dead position of the needle bar. A shallow and sharp cut is formed at a high speed by establishing a considerably high lower dead position, while a deep cut is formed by establishing a considerably low lower dead position.

For performing a marking operation on a work piece having a great resistance such as a suede, the present device is capable of sticking the sewing needle only by the tip thereof in the work piece, by changing the lower dead position of a needle bar to a higher position. Thus, the present device does not produce excessively large holes or marks in the work piece and, in particular, minimizes the frictional heat generated between the sewing needle and the work piece. Accordingly, the present device performs the marking operation at a high speed.

In the normal sewing, the present device is capable of changing the upper dead position of the needle bar to a sufficiently high position and thereby stopping and holding the sewing needle at the sufficiently high, upper dead position where the needle permits a work cloth to easily be mounted on the sewing machine. Stated differently, the present device prevents the interference of the sewing needle with the work cloth which is being mounted, and additionally reduces the operational noise thereof without lowering the operational speed thereof.

According to a preferred feature of the present invention, the dead-position changing means changes the lower dead position of the needle bar and does not change the upper dead position of the needle bar.

According to another feature of the present invention, the dead-position changing means changes the upper dead position of the needle bar and does not change the lower dead position of the needle bar.

According to yet another feature of the present invention, the dead-position changing means changes each of the upper and lower dead positions of the needle bar.

In a preferred embodiment of the present invention, the dead-position changing means comprises amplitude reducing means for reducing an amplitude of the axial-direction oscillation of the needle bar, and thereby changing the lower dead position of the needle bar to a new lower dead position where the sewing needle cannot stick in a work cloth. For the skip stitching, the amplitude reducing means may reduce the amplitude of the oscillation of the needle bar, so as to change the lower dead position of the needle bar from a first predetermined position in which the sewing needle can carry out the normal sewing on the work cloth, to a second predetermined position which is higher than the first predetermined position and where the sewing needle cannot stick in the work cloth. Therefore, when the needle bar is oscillated in the axial direction thereof, the needle bar is moved down to the lower dead position above the work cloth and subsequently the needle bar is moved up. Thus, the sewing needle cannot stick in the work cloth, so that no hole or mark cannot be formed in the work cloth and accordingly no stitch cannot be formed on the work cloth. Stated differently, even in the skip stitching, the needle bar is oscillated, so that the work cloth is prevented from being dragged by the needle thread. In addition, no hole is formed in the work cloth. Thus, the quality of the sewn cloth or product is improved.

In another embodiment of the present invention, the dead-position changing means comprises a reciprocative member which is reciprocated in synchronism with the axial-direction oscillation of the needle bar; holding means for holding the reciprocative member when the reciprocative member is displaced to a predetermined position; a dead-position changing mechanism for changing the at least one of the upper and lower dead positions of the needle bar, according to a first state of the holding means in which the holding means holds the reciprocative member and a second state of the holding means in which the holding means does not hold the reciprocative member.

In a preferred form of the above-indicated second embodiment, the dead-position changing means further comprises displacing means for displacing the reciprocative member to come near to, and back away from, the holding means, in synchronism with the axial-direction oscillation of the needle bar. The displacing means may comprise a cam having a cam surface, the cam being rotated in synchronism with the axial-direction oscillation of the needle bar; a cam follower; a biasing means for biasing the cam follower against the cam surface of the cam; and a transmission mechanism for transmitting movement of the cam follower to the reciprocative member. The cam surface may be adapted such that as the reciprocative member moves nearer to the holding means the rate or speed of the movement of the reciprocative member decreases. This arrangement permits the holding means to hold the reciprocative member in a soft manner, thereby avoiding generation of a large impact noise.

In another form of the second embodiment, the holding means comprises an electromagnetic device for attracting and holding, by a magnetic force, the reciprocative member which is formed of a magnetic material and which is movable relative to the electromagnetic device to come near to, and back away from, the electromagnetic device; and control means for controlling the electromagnetic device to produce the magnetic force when the reciprocative member comes nearest to the electromagnetic device. Since the control means controls the electromagnetic device to produce the magnetic force when the reciprocative member moves nearest to the electromagnetic device, the electric current necessary to attract the reciprocative member to the electromagnetic device is minimized. This arrangement also permits the electromagnetic device to attract the reciprocative member in a soft manner, without generating a large impact noise. Alternatively, it is possible to adapt the holding means to comprise a permanent magnet which attracts the reciprocative member when the reciprocative member comes nearest to the electromagnetic device and simultaneously the supply of electric current to the electromagnetic device is ceased. In the latter case, since the magnetic force necessary to attract the reciprocative member to the electromagnetic device is minimized, the electric current necessary to eliminate the magnetic force of the permanent magnet for causing the reciprocative member to be separated from the magnetic device is minimized. In either case, the size of the electromagnetic device can be reduced. Thus, the lower dead position of the needle bar is changeable with various advantages. The control means may comprise a detectable member which is displaced in synchronism with the reciprocation of the reciprocative member; a detector for detecting the detectable member when the reciprocative member comes nearest to the electromagnetic device, and generating a detection signal indicating that the reciprocative member has come nearest to the electromagnetic device; and means responsive to the detection signal, for controlling the electromagnetic device to produce the magnetic force.

In yet another form of the second embodiment, the holding means comprises a pawl which is engageable with the reciprocative member to hold the reciprocative member; and an electromagnetic device which displaces the pawl to an operative position thereof in which the pawl is engageable with the reciprocative men%her and to a retracted position thereof in which the pawl is not engageable with the reciprocative member.

According to an advantageous feature of the present invention, the needle-bar driving device further comprises a manually operable member which is displaceable by an operator to an operative position thereof in which the manually operable member holds the reciprocative member at substantially a same position as a position where the reciprocative member is held by the holding means, and to an inoperative position thereof in which the manually operable member permits the reciprocative member to freely be displaced.

According to another advantageous feature of the present invention, the dead-position changing means comprises a hydraulically operated cylinder device including a piston which is movable to a first and a second position thereof; and a dead-position changing mechanism for changing the at least one of the upper and lower dead positions, according to the first and second positions of the piston.

In a further embodiment of the present invention, the dead-position changing means comprises a rotatable member which is rotatable about an axis line; a slidable member mounted on the rotatable member such that the slidable member is rotatable about the axis line when the rotatable member is rotated about the axis line and that the slidable member is slidable in a direction in which the slidable member comes near to, and backs away from, the axis line and therefore a radius of the rotation of the slidable member is changed; a transmission mechanism for transmitting the reciprocation of the reciprocative member to the slidable member; and a link mechanism for transmitting the rotation of the slidable member to the needle bar. The needle-bar driving device may further comprise a needle-bar driving motor; and a crank mechanism for converting rotation of the driving motor to reciprocation, the rotatable member comprising a bell-crank lever which is provided between the crank mechanism and the needle bar and which is swingable about the axis line, the bell-crank lever having two arms one of which is connected to the crank mechanism and the other of which is connected to the slidable member such that the slidable member is slidable along a longitudinal direction of the other arm.

In an advantageous embodiment of the present invention, the needle-bar driving device is driven by an electric motor which is rotatable in each of a positive direction and a reverse direction opposite to the positive direction and which is controllable with respect to an angle of the rotation in the each direction, wherein the dead-position changing means comprises a motor control device which changes the at least one of the upper and lower dead positions of the needle bar by changing the angle of rotation of the electric motor in at least one of the positive and reverse directions.

In another advantageous embodiment of the present invention, the needle-bar driving device is for a multi-head sewing machine having a plurality of heads each of which includes at least one needle bar, the dead-position changing means comprising common dead-position changing means for changing at least one of the upper and lower dead positions of the at least one needle bar of each of the heads, together with each other. Since the upper or lower dead positions of a plurality of needle bars are changed simultaneously by the common dead-position changing means, this needle-bar driving device may have a simpler construction than that of a needle-bar driving device in which a dead-position changing means is provided for each of the needle bars. Consequently, the size of the needle-bar changing device may be reduced, and the cost of manufacture of the device may be lowered.

In yet another advantageous embodiment of the present invention, the needle-bar driving device further comprises stop control means for stopping the needle bar at substantially a predetermined position, irrespective of whether the dead-position changing means has changed the at least one of the upper and lower dead positions of the needle bar. For example, irrespective of whether in the normal sewing or the skip stitching, the stop control means stops the needle bar at substantially the predetermined position. Therefore, when being applied to a multi-needle sewing machine having a plurality of sewing needles, the needle-bar driving device permits a desired needle or needle bar to easily be selected from the needles or needle bars, since the needle bars are stopped at substantially the common, predetermined position. Thus, the construction of the device is simplified and accordingly the cost of manufacture of the device is reduced. In addition, the operational efficiency of the device is improved. Further, the present device permits a needle-thread passing apparatus or an operator to easily pass a needle thread through the eye of a sewing needle held by the needle bar, since the needle bar is always stopped at a desired predetermined position. This advantage is amplified particularly in the case where the present device is applied to a multi-needle sewing machine, since the needle-thread passing apparatus or operator can pass the thread needle through the eye of a sewing needle held at the predetermined position. Thus, the present device enjoys increased operational efficiency, or the present device contributes to increasing the working efficiency of the operator. The stop control means may be adapted to stop the needle bar at substantially the upper dead position thereof as the predetermined position, irrespective of whether the lower dead position of the needle bar is changed by the dead-position changing means or whether the amplitude of the needle bar has been changed.

In a further advantageous embodiment of the present invention, the stop control means stops the needle bar at a position, as the predetermined position, when a thread take-up lever of the sewing machine reaches an upper dead position thereof. The position of the needle bar when the thread take-up lever reaches the upper dead position thereof is changed by substantially no distance, even if the lower dead position of the needle bar is changed, for example, between the normal sewing mode and the skip stitching mode. Therefore, even in the event that the lower dead position of the needle bar is changed and accordingly the amplitude of the needle bar is changed, the present device permits a desired needle bar to easily be selected or changed, and an neele thread to easily be passed through the eye of the sewing needle.

BRIEF DESCRIPTION OF THE DRAWINGS

The above and optional objects, features and advantages of the present invention will be better understood by reading the following detailed description of the presently preferred embodiments of the invention when considered in conjunction with the accompanying drawings, in which.

DETAILED DESCRIPTION OF THE PREFERRED EMBODIMENTS

Figure 1:
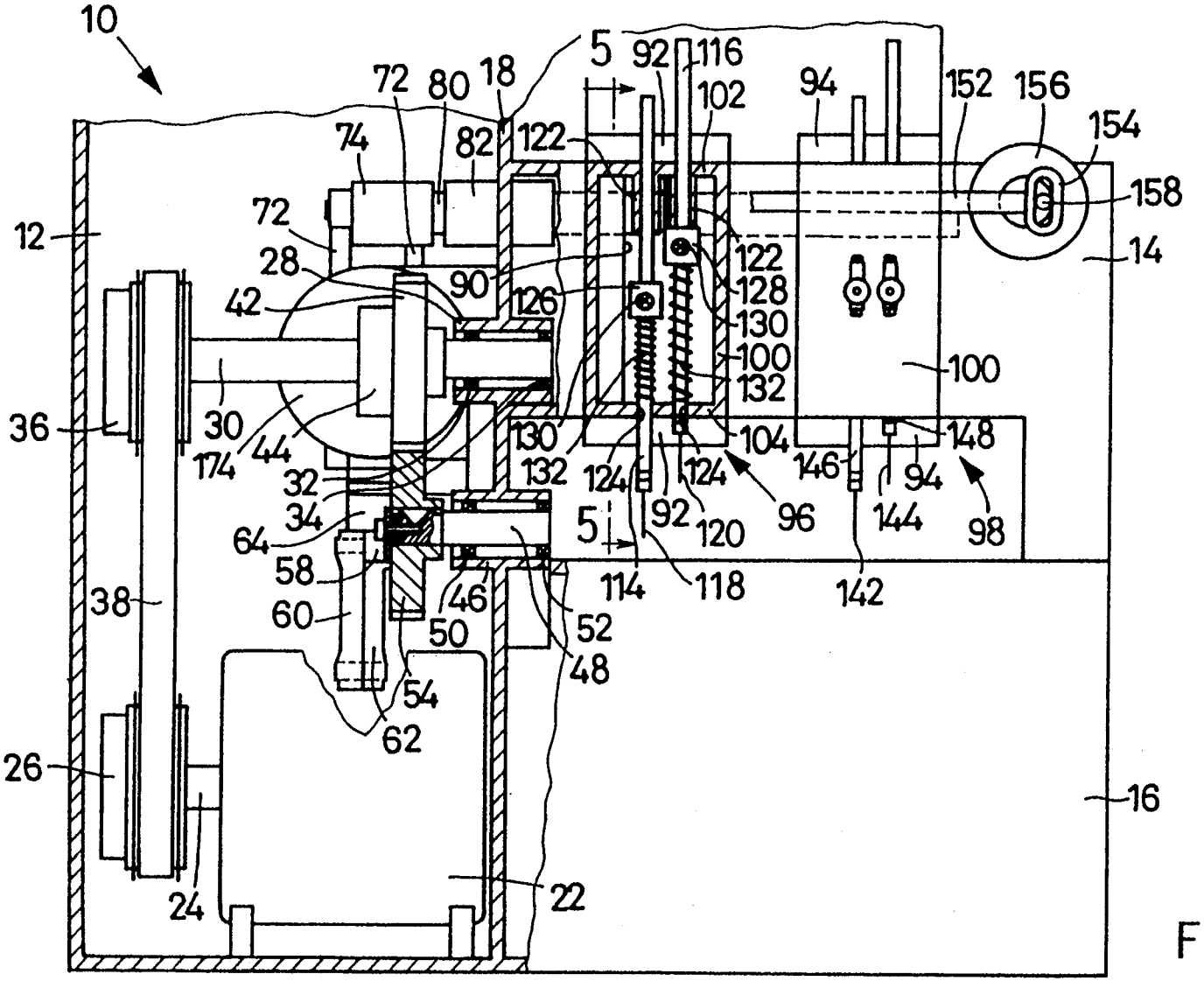
FIG. 1 is a front view, partly in section, of a part of a sewing machine to which a needle-bar driving device in accordance with the present invention is applied.

Referring first to FIG. 1, there is illustrated the first embodiment of the needle-bar driving device in accordance with the present invention. The first embodiment is applied to a sewing machine which is capable of carrying out the skip stitching.

In FIG. 1, reference numeral 10 designates a frame of the sewing machine. The frame 10 includes a column 12, an arm 14, and a bed 16. Each of the arm 14 and bed 16 extends horizontally from a corresponding portion of the column 12, such that the arm 14 and bed 16 are separate from the column 12 by a partition wall 18.

In the column 12, there is provided a main motor 22 having an output shaft 24. A first pulley 26 is mounted on the output shaft 24 of the main motor 22, such that the first pulley 26 and output shaft 24 are not rotatable or movable relative to each other. The partition wall 18 is formed with a first boss 28. The first boss 28 supports one of opposite ends of a first wheel shaft 30 via a pair of bearings 32, 34, such that the first wheel shaft 30 is rotatable relative to the boss 28 or partition wall 18. The first wheel shaft 30 extends parallel to the output shaft 24 of the main motor 22. A second pulley 36 is mounted on the other end of the first wheel shaft 30, such that the second pulley 36 and first wheel shaft 30 are not rotatable or movable relative to each other. The first and second pulleys 26, 36 are connected to each other by a belt 38 wound therearound, so that the rotation of the main motor 22 is transmitted to the first wheel shaft 30.

A first wheel 42 and an eccentric cam 44 are mounted on the first wheel shaft 30, such that each of the first wheel 42 and eccentric cam 44 is not rotatable or movable relative to the first wheel shaft 30. The partition wall 18 has a second boss 46 located below the first boss 28. A second wheel shaft 48 is supported by the second boss 28 via a pair of bearings 50, 52, such that the second wheel shaft 48 is rotatable relative to the second boss 46 or partition wall 18. A second wheel 54 is mounted on a free end of the second wheel shaft 48, such that the second wheel 54 is not rotatable or movable relative to the second wheel shaft 48. The first and second wheels 42, 54 have an equal diameter and are in engagement with each other.

Figure 2:
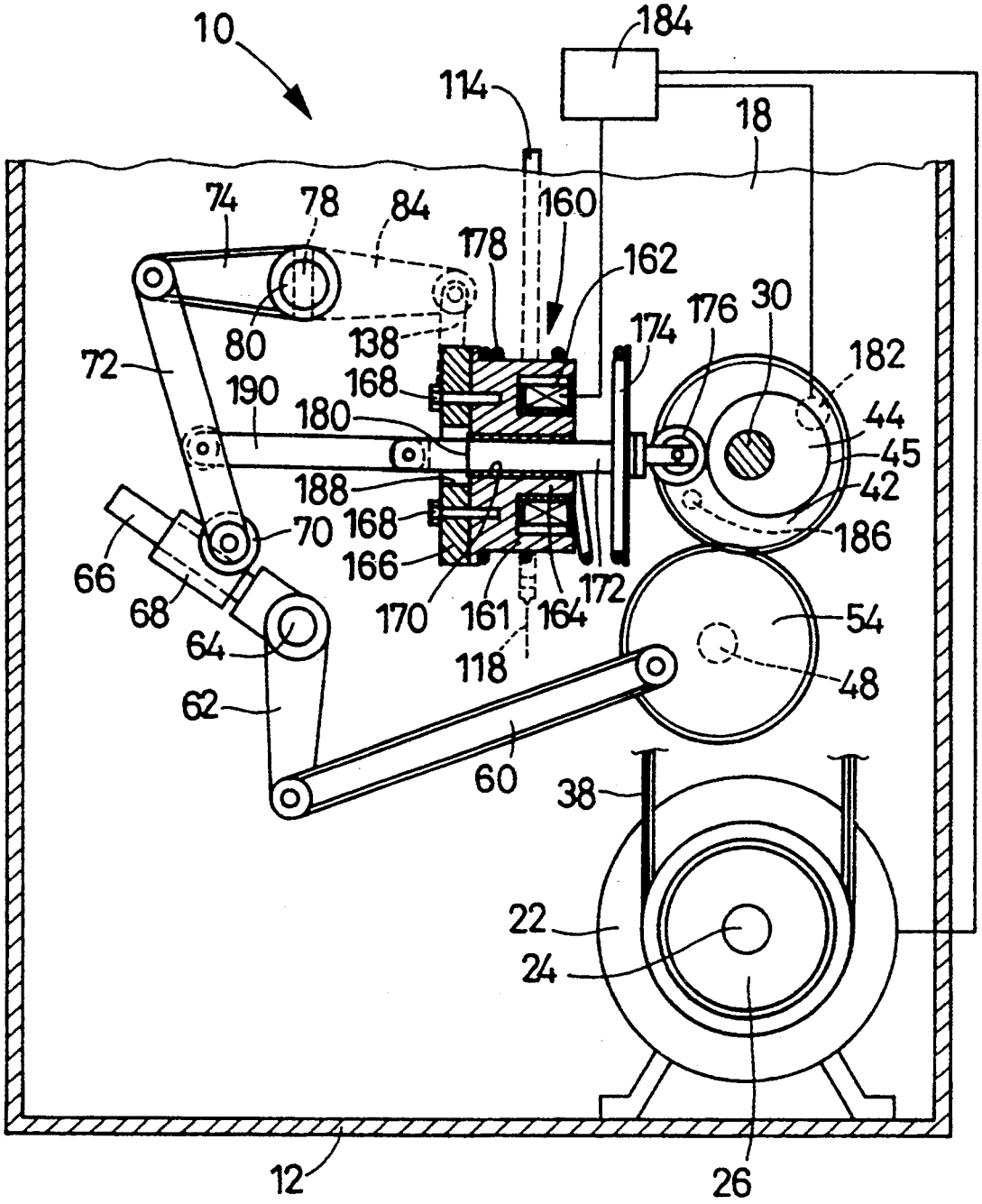
FIG. 2 is a front sectional view of the needle-bar driving device of FIG. 1, illustrating a state of the device in which a needle bar has reached the lower dead position thereof when the sewing machine is in the skip stitching mode thereof.

One of opposite ends of a first link 60 is connected via a spacer 58 to one of opposite surfaces of the second wheel 54. The other end of the first link 60 is connected to one of two arms of a first lever 62 serving as a rotatable member. As shown in FIG. 2, the first lever 62 has a configuration like a bell-crank, and is supported by the partition wall 18 via a first axis member 64 such that the first lever 62 is pivotable about the first axis member 64. Thus, when the second wheel 54 is rotated, the first lever 62 is pivoted about the first axis member 64 through the movement of the first link 60. The second wheel 54 and first link 60 cooperate with each other to serve as a crank mechanism. The other arm of the first lever 62 serves as a rod-like slide shaft 66. A cylindrical slider 68 serving as a slidable member is slidably fitted on the slide shaft 66 of the first lever 62. The slider 68 includes a lug-like connection portion 70 which is sandwiched by the corresponding ends of a pair of second links 72. The second links 72 are connected to the slider 68 such that each second link 72 is pivotable relative to the slider 68. The other, corresponding ends of the second links 72 are connected to a free end of a second lever 74.

Figure 5:
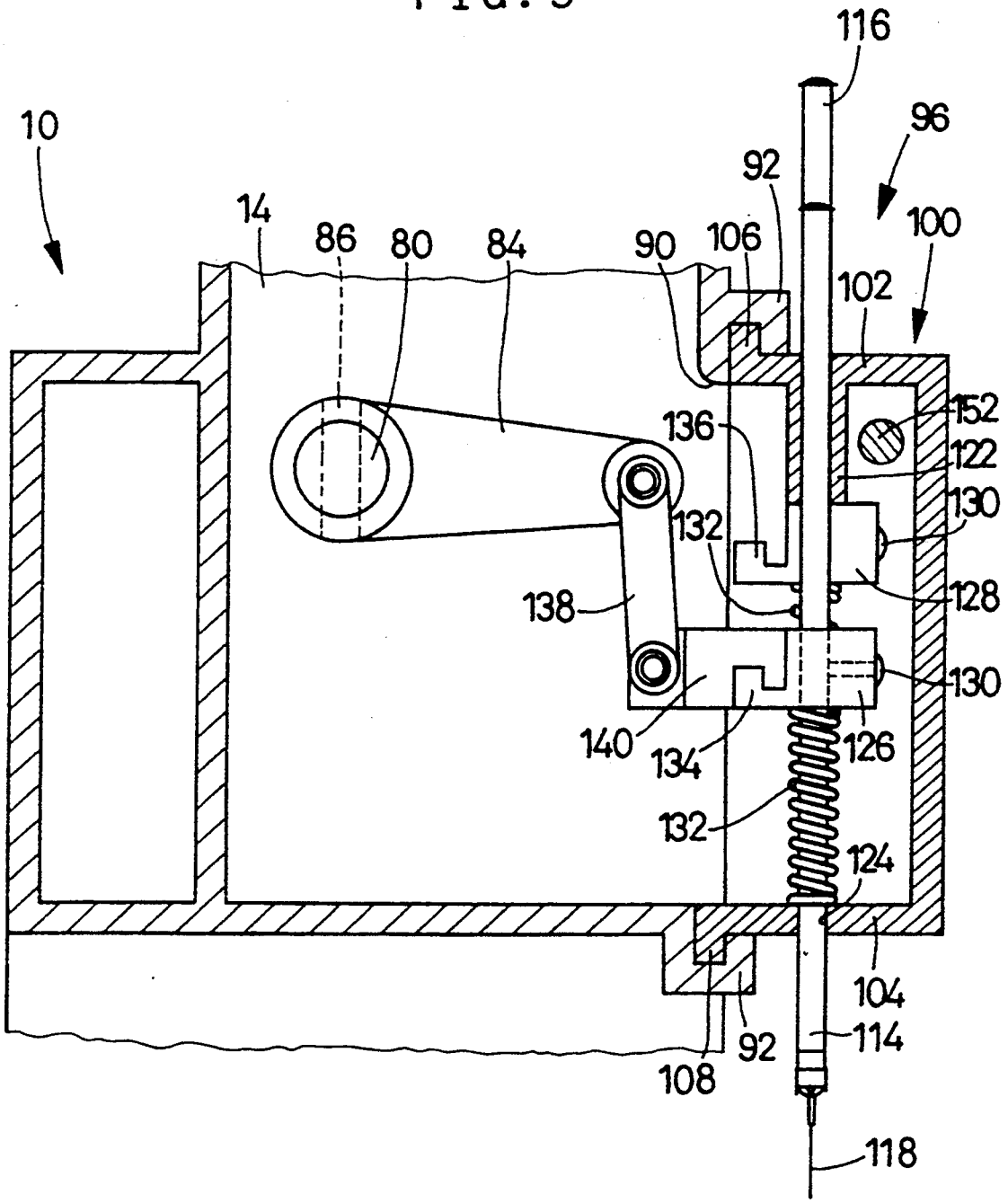
FIG. 5 is a sectional view of FIG. 1, taken along the line 5—5.

The other end of the second lever 74 is fitted on a needle-bar shaft 80, and is fixed thereto with a first spring pin 78 such that the second lever 74 and needle-bar shaft 80 are not rotatable or movable relative to each other. The needle-bar shaft 80 is supported by a third boss 82 formed in the partition wall 18, such that the needle-bar shaft 80 is rotatable relative to the third boss 82 or partition wall 18. The needle-bar shaft 80 supports the second lever 74 in the column 12, and supports in the arm 14 two third levers 84 (only one is shown in broken line in FIG. 2) at axially distant two locations. Each of the two third levers 84 extends from the needle-bar shaft 80 in a direction opposite to the direction in which the second lever 74 extends therefrom. As shown in FIG. 5, like the second lever 74, each third lever 84 is fixed to the needle-bar shaft 74 with a second spring pin 86. The second links 72, second lever 74, needle-bar shaft 80, and third levers 84 cooperate with each other to serve as a link mechanism.

Thus, the pivotal movement of the first lever 62 about the first axis member 64 is transmitted to the second lever 74 via the slider 68 and second links 72, and the pivotal movement of the second lever 74 is transmitted to the third levers 84 via the needle-bar shaft 80.

As shown in FIGS. 1 and 5, the arm 14 has two openings 90 (only one is shown in each figure) at two locations corresponding to the two third levers 84. The top and bottom portions of one of the two openings 90 are respectively provided with a pair of first guide rails 92 extending in the longitudinal direction of the arm 14, while the top and bottom portions of the other opening 90 are respectively provided with a pair of second guide rails 94 extending in the same direction. A first head 96 is supported by the arm 14 via the first guide rails 92, such that the first head 96 closes the above-indicated one opening 90. Likewise, a second head 98 is supported by the arm 14 via the second guide rails 94, such that the second head 98 closes the above-indicated other opening 90. Each of the first and second heads 96, 98 includes a box-like needle-bar case 100 which is open toward the frame 10. Each needle-bar case 100 has a top and a bottom plate 102, 104 which respectively have horizontally extending top and bottom engagement portions 106, 108 which are in slidable engagement with a corresponding one of the two pairs of guide rails 92, 94.

The needle-bar case 100 of the first head 96 supports a first and a second needle bar 114, 116, such that each of the two needle bars 114, 116 can vertically be oscillated. The first and second needle bars 114, 116 support at lower ends thereof a first and a second sewing needle 118, 120, respectively. Each of the first and second needle bars 114, 116 extends through a guide sleeve protruding downward from the top plate 102 of the case 100 and through a cylindrical hole 124 formed through the thickness of the bottom plate 104 of the case 100 of the first head 96. A first and a second engagement member 126, 128 are fitted on middle locations of the first and second needle bars 114, 116, and are fixed thereto with respective screws 130. A spring 132 is provided between each of the two engagement members 126, 128 and the bottom plate 104, so as to bias a corresponding needle bar 114, 116 in an upward direction. The "upper dead position" of each needle bar 114, 116 means the highest position of the upward movement thereof, and it is limited by the contact of the upper surface of each engagement member 126, 128 with the lower surface of a corresponding guide sleeve 122. When the needle bars 114, 116 are not being driven, the needle bars 114, 116 are held at the upper dead positions thereof which are at the same vertical level. The vertical positions of the needle bars 114, 116 relative to the case 100 of the first head 96 are adjustable by unscrewing the corresponding screws 130 and changing the axial positions of the corresponding engagement members 126, 128 relative to the needle bars 114, 116.

As shown in FIG. 5, the first and second engagement members 126, 128 have a first and a second engagement portion 134, 136, respectively, each of which has an L-shaped configuration. Each of the two third levers 84, connected to the needle-bar shaft 80, has a free end to which a transmitter 140 is pivotally connected via a third link 138. Each of the two transmitters 140 has an engagement portion which is engageable with a corresponding one of the engagement portions 134, 136 of the first and second engagement members 126, 128. If each transmitter 140 were engaged with neither the first nor second engagement members 126, 128, each transmitter 140 would be pivoted due to its own weight so as to vertically suspend from a corresponding third link 138. However, each transmitter 140 is always in engagement with either the first or second engagement member 126, 128, and thus is prevented from being pivoted. FIG. 5 shows that the transmitter 140 corresponding to the first head 96 is in engagement with the first engagement portion 134 of the first engagement member 126, such that the convex and concave portions of the transmitter 140 are in engagement with the concave and convex portions of the first engagement portion 134. Thus, the transmitter 140 continues to take a horizontal position. Therefore, when the third lever 84 is pivoted in a clockwise direction and the transmitter 140 is moved downward due to downward movement of the third link 138, the first needle bar 114 is moved downward against the biasing force of the spring 132 due to downward movement of the first engagement member 126. Meanwhile, when the third lever 84 is pivoted in a counterclockwise direction and the transmitter 140 is moved upward due to upward movement of the third link 138, the first needle bar 114 is moved upward up to the upper dead position thereof due to the biasing force of the spring 132, with the transmitter 140 being held in engagement with the first engagement member 126.

In the present embodiment, the pivotal movement of the third lever 84 for the first head 96 is converted to the vertical oscillations of the needle bars 114, 116 via the third link 138, transmitter 140 and engagement members 126, 128. The lower dead positions of the needle bars 114, 116 are changeable by changing the amount of pivotal movement of the third lever 84.

The second head 98 has a structure similar to that of the first head 96. Specifically, the second head 98 includes a third and a fourth needle bar 146, 148 which support at lower ends thereof a third and a fourth sewing needle 142, 144, respectively. Each of the third and fourth needle bars 146, 148 is vertically oscillated. The upper dead positions of the third and fourth needle bars 146, 148 are determined at the same vertical level as that of the upper dead positions of the first and second needle bars 114, 116. When the sewing machine is not being operated, the third and fourth needle bars 146, 148 are held at the upper dead positions thereof. The third and fourth needle bars 146, 148 are provided with respective engagement members (not shown) similar to the first and second engagement members 126, 128. A third lever 84 corresponding to the second head 98 has a free end to which a transmitter 140 is pivotally connected via a third link 138. This transmitter 140 is engageable with either one of the engagement members provided on the third and fourth needle bars 146, 148.

Thus, the pivotal movement of the third lever 84 for the second head 98 is converted to the vertical oscillations of the needle bars 146, 148 via the third link 138, transmitter 140 and respective engagement members. The lower dead positions of the needle bars 144, 148 are changeable by changing the amount of pivotal movement of the third lever 84.

Each of the two third levers 84 is pivoted together with the needle bar shaft 80. Therefore, when the second lever 74 is pivoted, the two third levers 84 are simultaneously pivoted together with the needle bar shaft 80, so that the first or second needle bar 114 or 116 in engagement with the transmitter 140 in the first head 96 and the third or fourth needle bar 146 or 148 in engagement with the transmitter 140 in the second head 98 are simultaneously oscillated by an equal or common amplitude.

As shown in FIG. 1, a needle changing bar 152 extends parallel to the needle-bar shaft 80 in the arm 14. the needle changing bar 152 passes through opposite side walls of each of the first and second heads 96, 98. When the needle-change bar 152 is displaced in the axial direction thereof, the first and second heads 96, 98 are moved simultaneously by being guided by the first and second guide rails 92, 94, respectively. The needle changing bar 152 has at an end thereof an elongate ring 154 which is fitted on a crank shaft 158 fixed to an output shaft of a needle changing motor 156 disposed in the arm 14. Provided that the two transmitters 140 be in engagement with the first and third needle bars 114, 146, respectively and that all the first to fourth needle bars 114, 116, 146, 148 be not being driven, the needle changing bar 152 is displaced in the leftward direction in FIG. 1, when the needle-change motor 152 is operated and the crank shaft 158 is rotated by a half rotation or 180 degrees. Consequently, both the first and second heads 96, 98 are displaced in the leftward direction. The two transmitters 140 simultaneously are disengaged from the first and third needle bars 114, 146, respectively, and subsequently the two transmitters 140 are brought into engagement with the second and fourth needle bars 116, 148, respectively. In this state, when the third levers 84 are pivoted, the first and third needle bars 114, 146 remains held at the upper dead positions thereof and the second and fourth needle bars 116, 148 are driven, i.e., vertically oscillated.

As shown in FIG. 2, an electromagnetic device in the form of a solenoid 160 is provided between the eccentric cam 44 and the pair of second links 72. The solenoid 160 includes a yoke 161, a coil 162, and a core 164. When an exciting current is applied to the coil 162, the yoke 161 and core 164 are magnetized. The solenoid 160 is secured with bolts 168 to a support member 166 fixed to the partition wall 18. The core 164 has an axial hole 170 formed therethrough. A rod 172 is slidably fitted in the axial hole 170 of the core 164. A circular member or disc 174, serving as a reciprocative member, is provided at an end portion of the rod 172, such that the disc 174 and rod 172 are concentric with each other. A roller 176 is provided at the end of the rod 172. The disc 174 is formed of a magnetic material, and serves as a member to be attracted by the solenoid 160.

Figure 3:
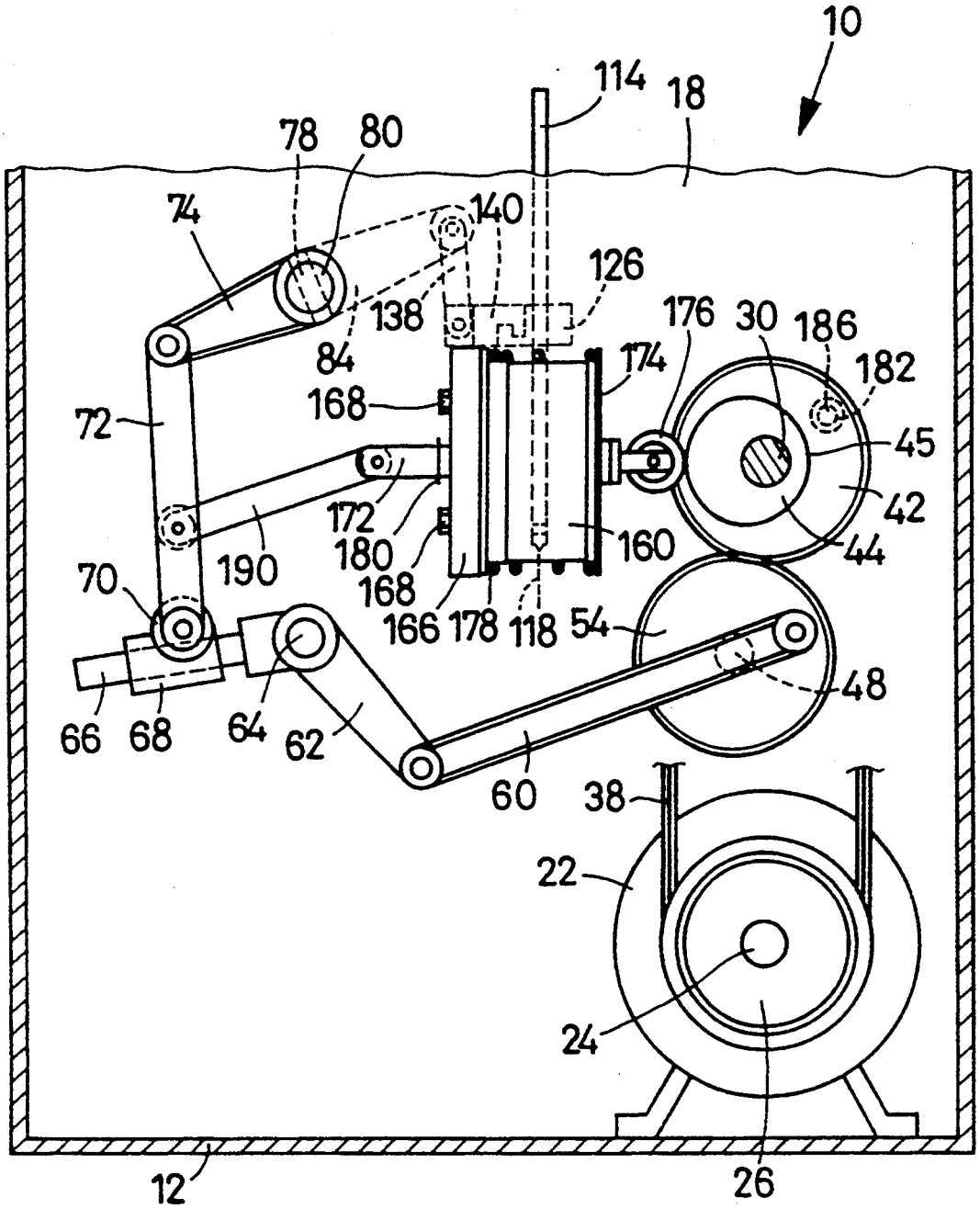
FIG. 3 is a front sectional view of the needle-bar driving device of FIG. 1, illustrating a state of the device in which the needle bar has reached the upper dead position thereof.

A spring 178 is provided between a stepped surface provided in the outer circumferential surface of the yoke 161 and a shoulder surface of the disc 174. The spring 178 biases the disc 174 in a direction away from the solenoid 160, so that the roller 176 is engaged with a cam surface 45 of the eccentric cam 44. When the eccentric cam 44 is rotated, the rod 172 is displaced in the axial hole 170 of the core 164, so that the disc 174 comes near to, and backs away from, the solenoid 160. The cam surface 45 is formed such that as the disc 174 approaches the solenoid 160, the rate of approach of the disc 174 decreases and that when the disc 174 comes nearest to the solenoid 160, substantially no space is left between the disc 174 and the solenoid 160, as shown in FIG. 3. A stop ring 180 serves to prevent the rod 172 from falling off the axial hole 170 of the core 164. The eccentric cam 44, roller 176, rod 172, and spring 178 cooperate with each other to serve as displacing means.

Figure 6:
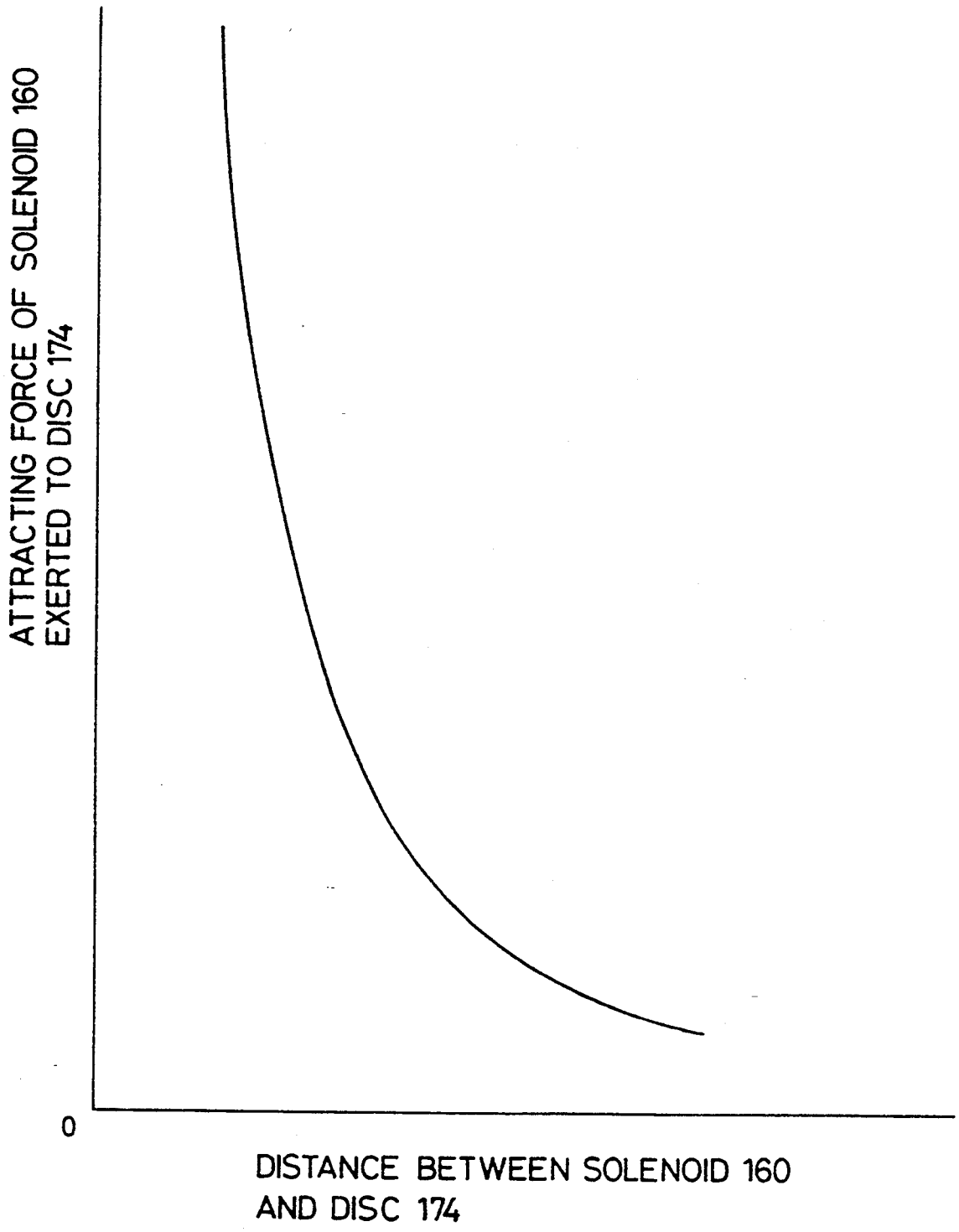
FIG. 6 is a graph showing the relationship between the distance between the solenoid 160 and the disc 174, and the attracting force of the solenoid 160 exerted to the disc 174.

As shown in FIG. 2, a reflection-type light-activated switch 182 is secured to the frame 10 of the sewing machine. The light-activated switch 182 is connected to a control device 184. Meanwhile, the first wheel 42 has a reflection area 186 in a surface thereof opposite to the light-activated switch 182. When the disc 174 comes nearest to the solenoid 160 due to the rotation of the eccentric cam 44, the reflection area 186 reflects a light emitted from the light-activated switch 182, back toward the switch 182, as shown in FIG. 3. It is assumed that the present sewing machine currently be placed in the normal stitching mode in which the normal stitching is being carried out. When the light-activated switch 182 detects a light reflected from the reflection area 186 of the first wheel 42, the switch 182 generates a detection signal to the control device 184, so that the control device 184 supplies an excitement signal to the solenoid 160 to magnetize the solenoid 160. Thus, when the disc 174 is moved to the position nearest to the solenoid 160, the solenoid 160 is magnetized. As can be understood from the graph shown in FIG. 6, a minimum exciting current is necessary in the present sewing machine to magnetize the solenoid 160 and thereby attract the disc 174 thereto. For this reason and the above indicated reason that as the disc 174 approaches the solenoid 160 the rate of approach of the disc 174 decreases, the noise of the impact produced when the disc 174 is attracted against the solenoid 160 is diminished. The solenoid or electromagnetic device 160 serves as holding means.

In the present embodiment, the eccentric cam 44 serve as means for decreasing the rate of approach of the disc 174, and the light-activated switch 182, reflection area 186 and control device 184 cooperate with each other to serve as means for controlling the operation of the electromagnetic device in the form of the solenoid 160.

The other end of the rod 172 opposite to the end thereof to which the roller 176 is secured, extends through a hole 188 formed through the support member 166, and is connected to middle portions of the pair of second links 72 via a fourth link 190. When the rod 172 is axially displaced due to the rotation of the eccentric cam 44, the fourth link 190 and therefore the second links 72 are displaced, so that the slider 68 is displaced on the slide shaft 66 of the first lever 62. The rod 172, fourth link 190, and second links 72 cooperate with each other to serve as a transmission mechanism.

When the operator operates an end switch (not shown) of the sewing machine to terminate the current sewing operation, the control device 184 generates, based on a detection signal from the light-activated switch 182, an end signal to a drive circuit (not shown) for the main motor 22, so as to stop the operation of the main motor 22. Irrespective of whether the skip stitching or normal sewing mode is ended on the sewing machine, the main motor 22 is stopped when the light-activated stitch 182 detects the reflection area 186, i.e., all the needle bars 114, 116, 146, 148 are placed at the upper dead positions thereof, as shown in FIG. 3. Consequently, the needle bars 114, 116, 146, 148 are stopped and held at the upper dead positions thereof.

In the needle-bar driving device constructed as described above, the first and second wheels 42, 54 and eccentric cam 44 are rotated when the main motor 22 is rotated. When, in the normal sewing mode, the disc 174 comes nearest to the solenoid 160 due to the rotation of the eccentric cam 44 and accordingly the light-activated switch 182 detects the reflection area 186, an exciting current is applied to the solenoid 160, so that the disc 174 is attracted to an end surface of the solenoid 160 and is held by the solenoid 160.

Figure 4:
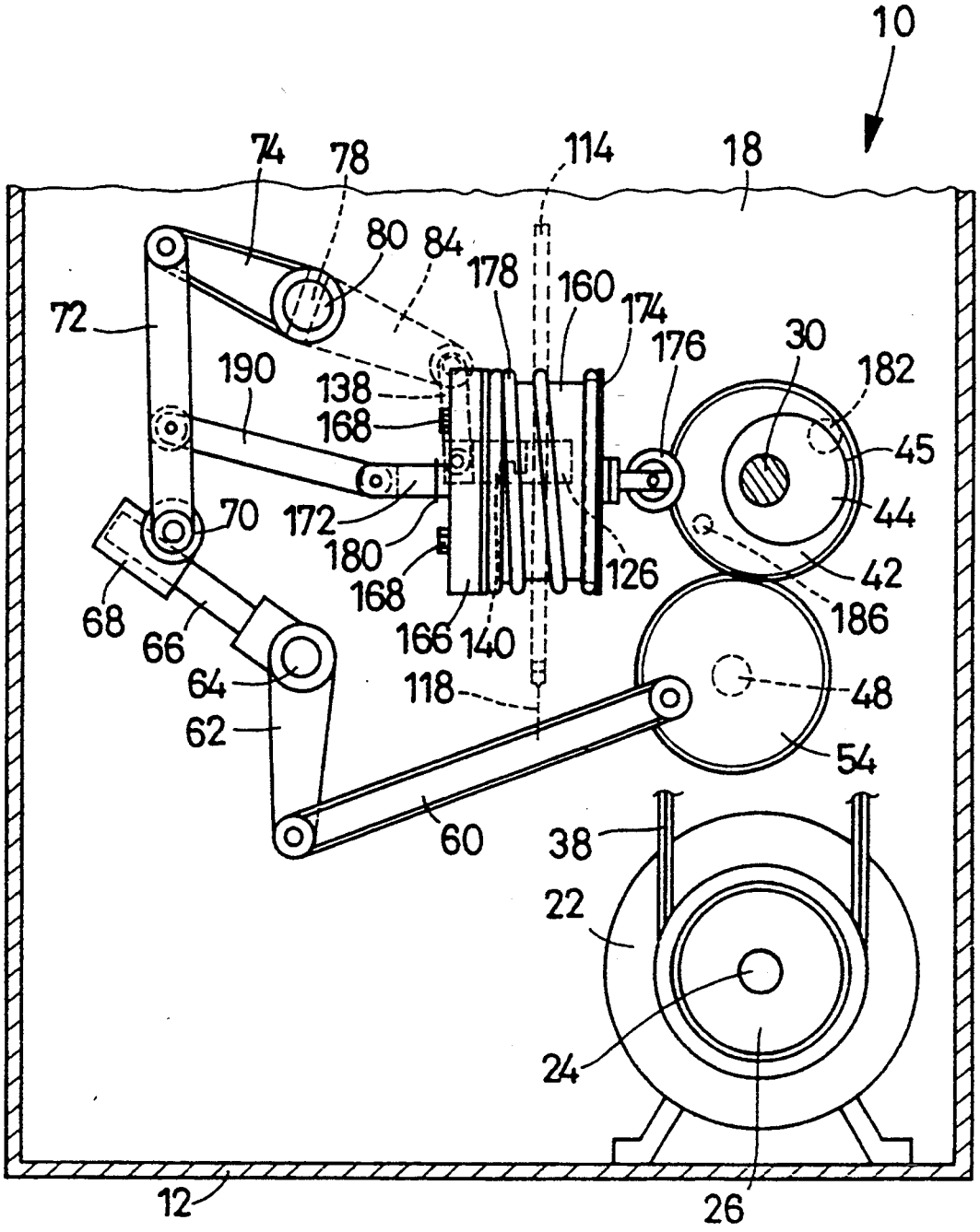
FIG. 4 is a front sectional view of the needle-bar driving device of FIG. 1, illustrating a state of the device in which the needle bar has reached the lower dead position thereof when the sewing machine is in the normal sewing mode thereof.
Figure 7:
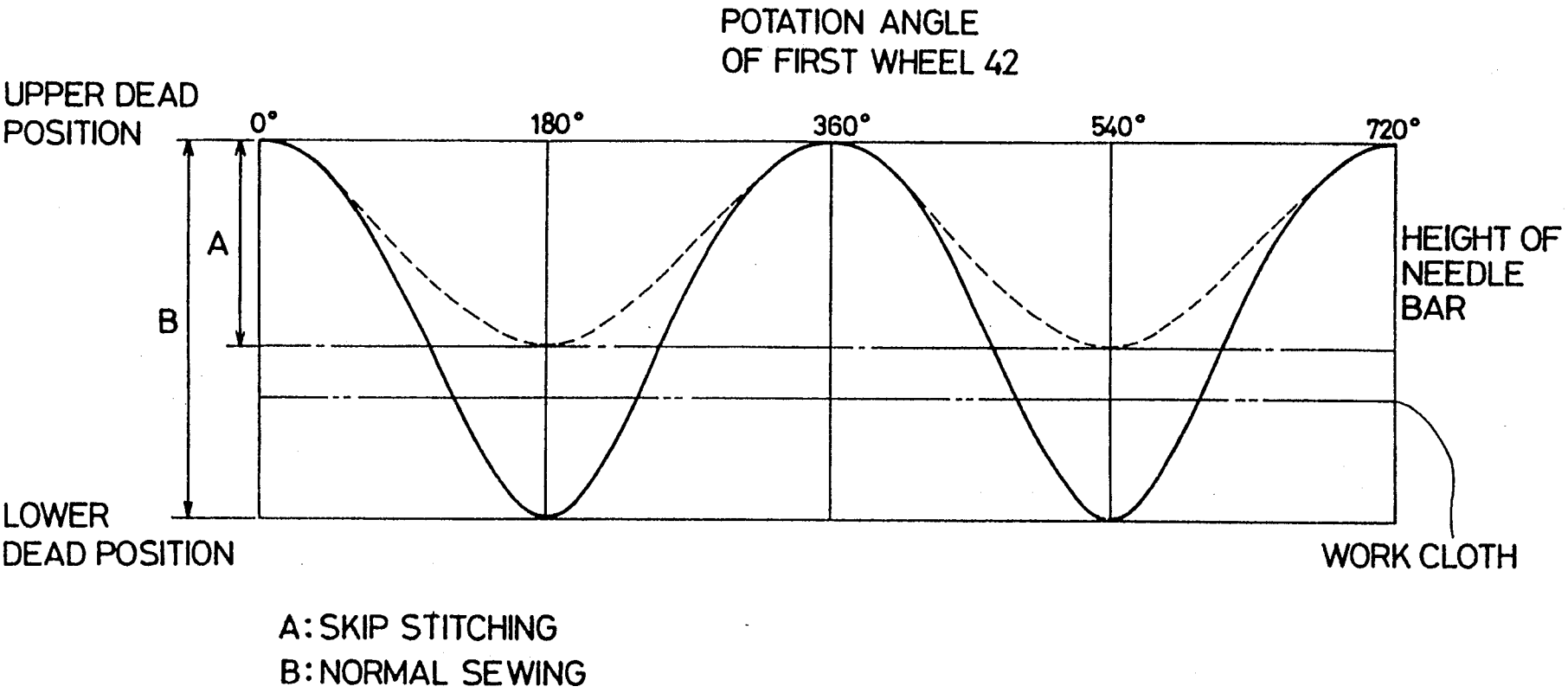
FIG. 7 is a graph showing the alteration of the oscillation amplitude of the needle bar between in the normal sewing mode and in the skip stitching mode.

With the disc 174 being held by the solenoid 160, the rod 172 and the fourth link 190 are positioned on the side of the second links 72, so as to slide the slider 68 to a free end of the slide shaft 66 of the first lever 62, as shown in FIG. 4. When the first lever 62 is pivoted in this state, the second links 72 are displaced up to the highest position, so that the second and third levers 74, 84 are pivoted by a maximum amount. Consequently, the needle bars 114, 146 are oscillated by a maximum amplitude. Thus, the needle bars 114, 146 are oscillated as indicated by a solid line in the graph shown in FIG. 7. When the needle bars 114, 146 are positioned at the lower dead positions thereof, the sewing needles 118, 142 sufficiently deeply penetrate respective work cloths supported on the bed 16. The vertical oscillations of the needle bars 114, 146 result in sewing the respective work cloths.

Meanwhile, in the skip stitching mode, the light-activated switch 182 is placed in an inoperative position ("OFF"), so that the solenoid 160 cannot be magnetized. Therefore, as shown in FIG. 2, the spring 178 biases the disc 174 toward the eccentric cam 44, so that the roller 176 is held in engagement with the cam surface 45 of the eccentric cam 44. When the eccentric cam 44 is rotated, the rod 172 and the fourth link 190 are reciprocated in the axial direction thereof.

When the roller 176 is retracted toward the solenoid 160 by a maximum amount by the cam surface 45, the rod 172 and fourth link 190 are positioned at substantially the same positions as those when the disc 174 is attracted and held by the solenoid 160. Simultaneously, the third levers 84 are pivoted in the counterclockwise direction, as shown in FIG. 3, so that the third levers 84 are pivoted by the same amount as that when the solenoid 160 is magnetized. Consequently, the upper dead positions of the needle bars 114, 146 are not changed between in the normal sewing mode and in the skip stitching mode.

As the eccentric cam 44 is further rotated from the state shown in FIG. 3, the rod 172 and the fourth link 190 are advanced or displaced toward the eccentric cam 44, by the biasing force of the spring 178, so that the second links 72 are displaced toward the eccentric cam 44. Consequently, the slider 68 is displaced toward the first axis member 64, as shown in FIG. 2. Therefore, in the skip stitching mode, the second links 72 are moved up to the highest position that is lower than that in the normal sewing mode. Stated differently, the amount or stroke of the upward movement of the second links 72 is smaller in the skip stitching mode than in the normal sewing mode. Thus, the clockwise pivotal movement amounts of the second and third levers 74, 84 are decreased as compared with those in the normal sewing mode, so that the needle bars 114, 146 are oscillated by a smaller amplitude than that in the normal sewing mode. In the skip stitching mode, the needle bars 114, 146 are oscillated as indicated in a broken line in the graph shown in FIG. 7. The lower dead positions of the needle bars 114, 146 in the skip stitching mode are higher than those in the normal sewing mode, in such a manner that the sewing needles 118, 142 cannot penetrate the respective work cloths in the skip stitching mode. In the skip stitching mode, therefore, no hole or mark is formed in the work cloths and no stitch is formed on the work cloths, though the sewing needles 114, 146 are vertically oscillated. The first lever 62, slider 68, second links 72, and fourth link 190 cooperate with each other to serve as a dead-position changing mechanism.

In the present embodiment, the eccentric cam 44, first lever 62, slider 68, second links 72, solenoid 160, rod 172, disc 174, roller 176, fourth links 190, and others cooperate with each other to serve as amplitude changing means and thus, dead-position changing means.

As described previously, the upper dead positions of the needle bars 114, 116, 146, 148 are not changed between in the skip stitching mode and in the normal sewing mode. In either mode, the needle bars 114, 116, 146, 148 are stopped and held at the upper dead positions thereof. Therefore, the transmitter 140 of each of the first and second heads 96, 98 is engaged with either one of the two engagement members (126, 128), by simply displacing the two heads 96, 98 in the horizontal direction. Thus, a desired one of the two needle bars 114 and 116 or 146 and 148 is easily selected for each of the two heads 96, 98. In addition, since the first and second heads 96, 98 are displaced together by moving the common needle changing bar 152, the needle selecting or changing operation is carried out simultaneously with respect Go the plural heads 96, 98.

In the present embodiment, the light-activated switch 182, reflection area 186, and control device 184 cooperate with each other to serve as stop control means for stopping each of the needle bars 114, 116, 146, 148 at a predetermined position.

As previously described, the electromagnetic device is constituted by the solenoid 160 including the yoke 161, coil 162 and core 164. In the normal sewing mode, the yoke 161 and core 164 are magnetized upon application of an exciting current to the coil 162, so as to attract the magnetic disc 174. However, it is possible to replace the core 164 with a permanent magnet. In the event that is used an electromagnetic device employing a permanent magnet in place of the core 164, the electromagnetic device attracts the disc 174 by utilizing the magnetic force of the permanent magnet, in the normal sewing mode, and the coil 162 is supplied with an electric current to eliminate the magnetic force of the permanent magnet, in the skip-stitch mode, so as to permit the disc 174 to be separated or retracted away from the electromagnetic device. In this case, it is unnecessary to supply an exciting current to the electromagnetic device, during the normal sewing mode. This arrangement contributes to reducing the electric power necessary to operate the needle-bar driving device.

Figure 8:
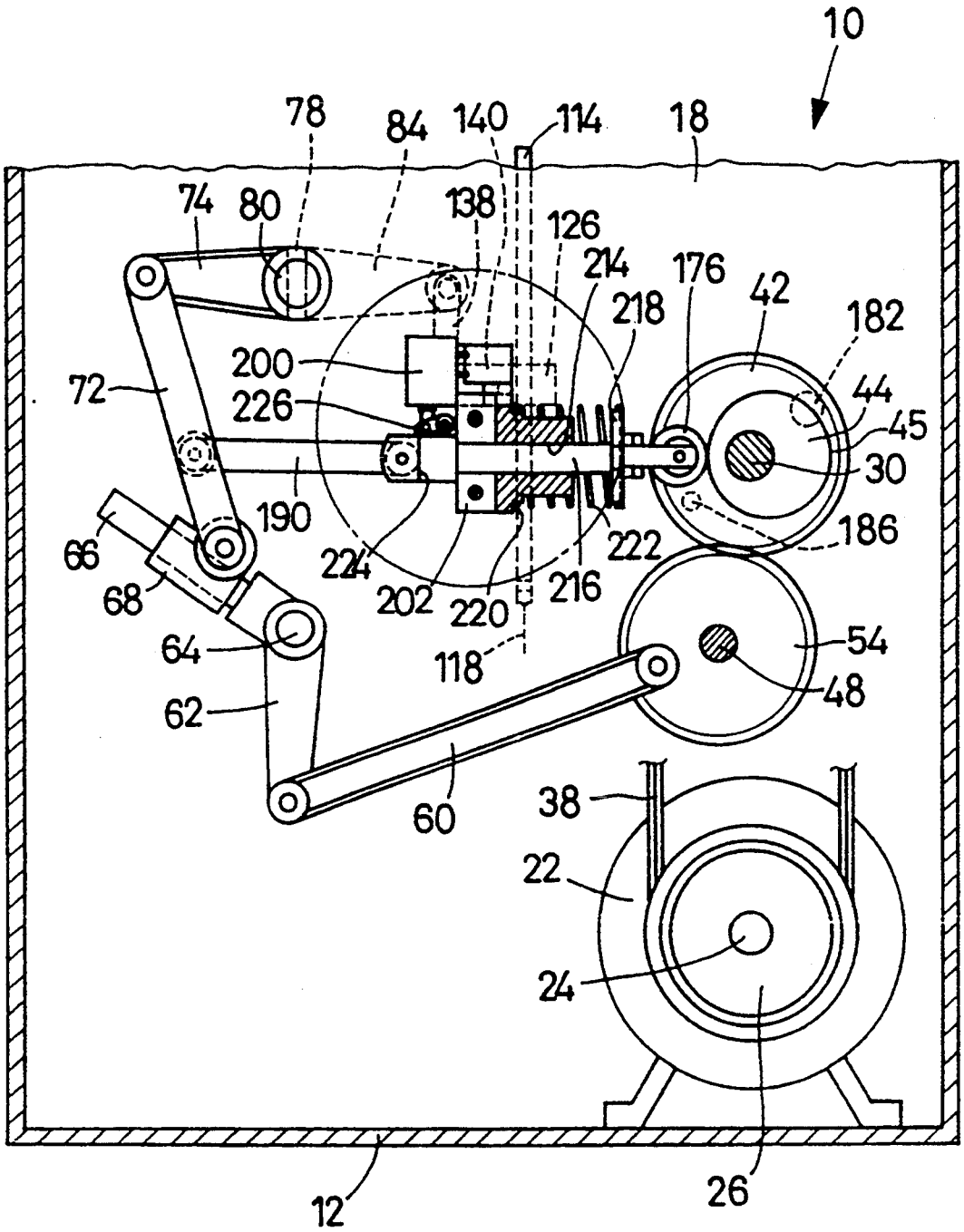
FIG. 8 is a front sectional view of a part of a sewing machine to which the second embodiment of the present invention is applied.
Figure 9:
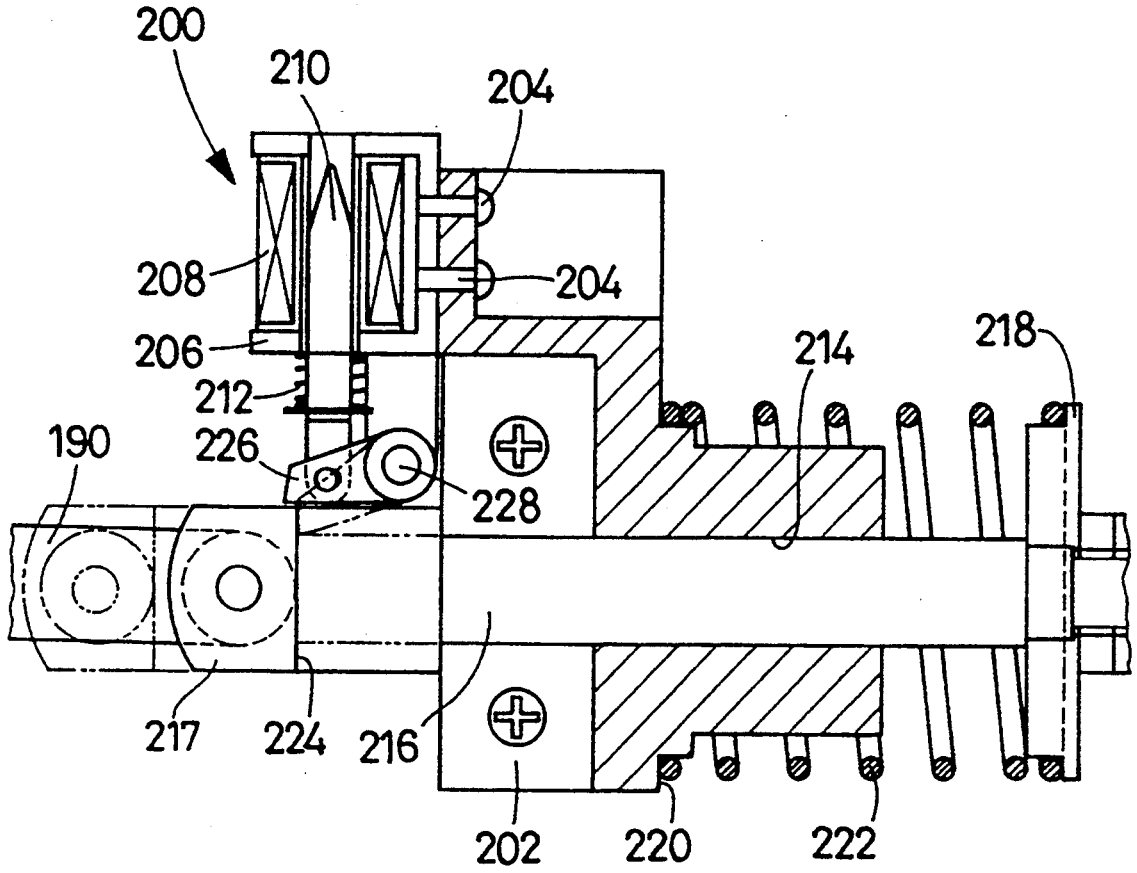
FIG. 9 is a front sectional view of a part of the needle-bar driving device of FIG. 8.

Referring next to FIGS. 8 and 9, there is illustrated the second embodiment of the present invention. The same reference numerals as those used for illustrating the first embodiment are also used for designating the corresponding elements or portions of the second embodiment, and repetitive description of those elements or portions are omitted.

In the second embodiment, a solenoid 200 is employed in place of the solenoid 160 used in the first embodiment. As shown in FIG. 9, the solenoid 200 is fixed to a support member 202 by using headed pins 204. The solenoid 200 includes a yoke 206, a coil 208, and a movable iron core 210. Upon application of an exciting current to the coil 208, the iron core 210 is retracted into the coil 208 against a biasing force of a first spring 212.

The support member 202 has an axial hole 214 formed therethrough, and a rod 216 is fitted in the axial hole 214 such that the rod 216 is movable in the axial direction thereof. A retainer 218 is fixed to the rod 216. At an end of the rod 216, a roller 176 is provided similar to the first embodiment. A second spring 222 is provided between the retainer 218 and a stepped surface of the support member 220. The second spring 222 biases the retainer 218 in a direction to engage the roller 176 with a cam surface 45 of an eccentric cam 44. The rod 216 includes a large-diameter portion 217 which is located outside the axial hole 214 of the support member 202. The large-diameter portion 217 has a shoulder surface 224 serving as an engagement portion engageable with the support member 202.

A pawl 226 is pivotally fixed at an end portion thereof to the support member 202 such that the pawl 224 is engageable at a free end portion thereof with the shoulder surface 224 of the rod 216. The pawl 226 is connected to an exposed end of the iron core 210, through a pin fixed to the iron core 210 and an elongate hole formed in the pawl 216. When the iron core 210 is displaced inside the coil 208, the pawl 226 is pivoted about an axis member 228.

In the normal sewing mode, no exciting current is applied to the solenoid 200, so that the iron core 210 is advanced out of the coil 208 due to the biasing force of the first spring 212. When the eccentric cam 44 is rotated and the rod 216 is displaced toward second links 72 by a maximum distance against the biasing force of the second spring 222, the pawl 226 is engaged with the shoulder surface 224 of the rod 216 as shown in two-dot chain line in FIG. 9, so that the rod 216 and a fourth link 190 are held at respective positions where the large-diameter portion 217 and fourth link 190 are spaced apart by a maximum distance from the support member 202.

Meanwhile, in the skip stitching mode, the solenoid 200 is magnetized when the rod 216 is displaced toward the second links 72 by a maximum distance due to the rotation of the eccentric cam 44. Consequently, the iron core 210 is retracted into the coil 208, so that the pawl 226 is pivoted and is disengaged from the shoulder surface 224 of the rod 216. Thus, the rod 216 is displaced toward the eccentric cam 44 by the biasing force of the second spring 222, so that the roller 176 is engaged with the cam surface 45 of the eccentric cam 44. As the cam 44 is rotated, the rod 216 and fourth link 190 are reciprocated in the axial direction thereof. In the second embodiment, therefore, a second lever 74 and a pair of third levers 84 are pivoted by a smaller amount in the skip stitching mode than that in the normal sewing mode, like in the first embodiment. Stated differently, the lower dead positions of needle bars 114, 116, 146, 148 become higher in the skip stitching mode than those in the normal sewing mode.

Figure 10:
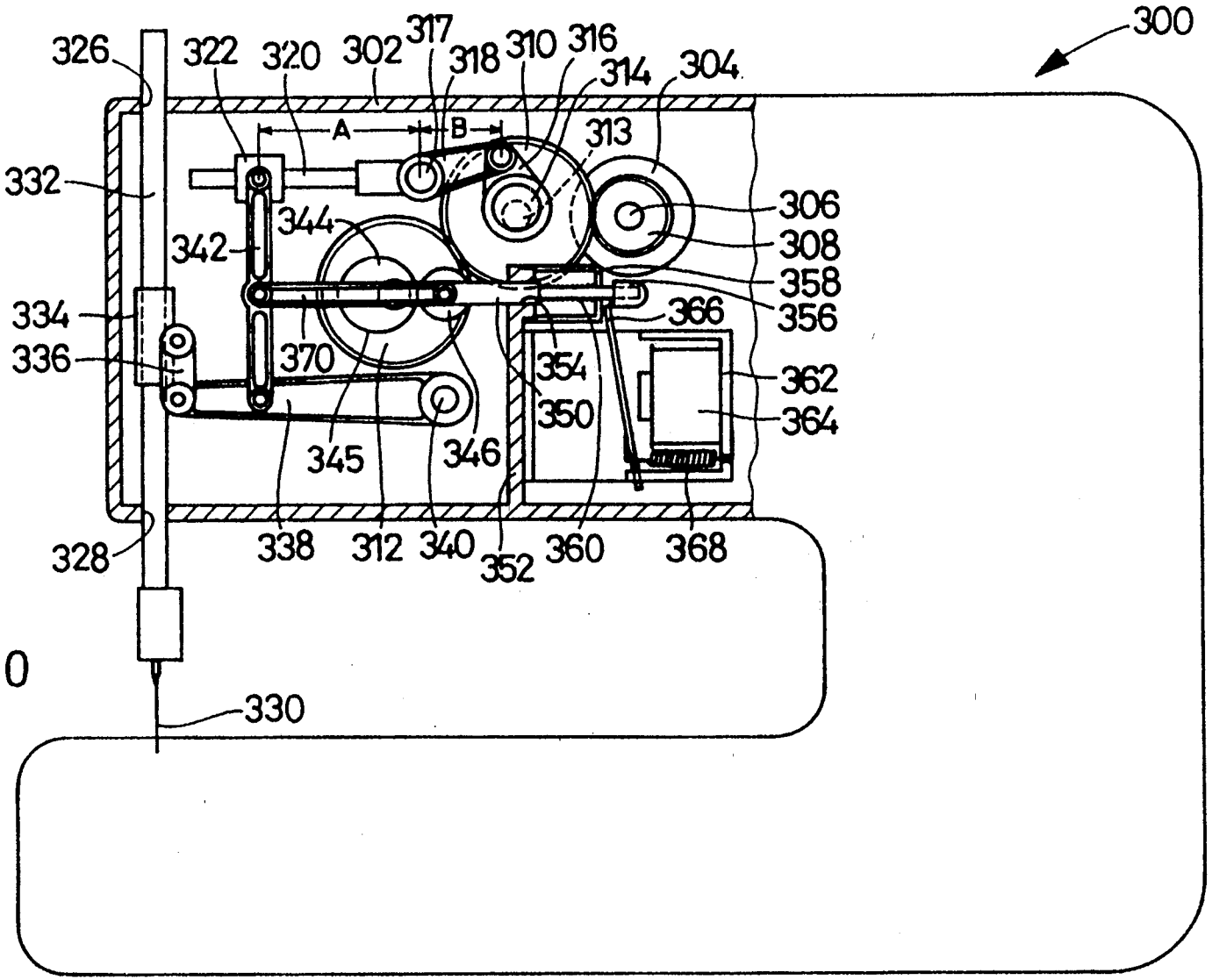
FIG. 10 is a front sectional view of a part of a sewing machine to which the third embodiment of the present invention is applied.

Referring next to FIG. 10, there is shown the third embodiment of the present invention.

In the figure, reference numeral 300 designates a frame of a sewing machine which employs a needle-bar driving device embodying the present invention. The frame 300 includes an arm 302 to which a main motor 304 is fixed. A first wheel 308 is mounted on an output shaft 306 of the main motor 304, such that the first wheel 308 is not rotatable relative to the output shaft 306. A second and a third wheel 310, 312 are supported by the arm 302. The first, second and third wheels 308, 310, 312 are in engagement with each other, so that the rotation of the first wheel 308 is transmitted to the second wheel 310 and then third wheel 312. The second wheel 310 is rotatable with a first axis member 313, and an eccentric shaft 314 is fixed to the first axis member 313 such that the eccentric shaft 314 is eccentric with the second wheel 310. A rocker 316 is pivotally fitted on the eccentric shaft 314. The rocker 316 is connected to one of two arms of a lever 318, serving as a slidable member. The lever 318 is supported by the arm 302 such that the lever 318 is pivotable about a second axis men, her 317. The other arm of the lever 318 serves as a slide shaft 320 on which a slider 322, serving as a slidable member, is slidably fitted. Thus, the rotation of the second wheel 310 is converted to rocking movement of the rocker 316 via the eccentric shaft 314, and the rocking movement of the rocker 316 is converted to pivotal movement of the lever 318 about the second axis member 317.

The arm 302 has at an end portion thereof a top and a bottom guide hole 326, 328 formed through the wall thereof. A needle bar 332 supporting at a lower end thereof a sewing needle 330, extends through the two guide holes 326, 328 such that the needle bar 332 can be oscillated vertically. A first link 336 is pivotally connected to a middle portion of the needle bar 332 via a sleeve 334, and a needle-bar lever 338 is pivotally connected at one end thereof to the first link 336. The needle-bar lever 338 is pivotally connected at the other end thereof to a needle-bar shaft 340 supported by the arm 302. The needle-bar lever 338 is connected to the slider 322 via a second link 342 which vertically extends substantially perpendicular to the slide shaft 320 of the lever 318.

An eccentric cam 344 is fixed to an axis member of the third wheel 312 such that the eccentric cam 344 is eccentric with the third wheel 312. When the third wheel 312 is rotated, the eccentric cam 344 is rotated together therewith. A cam surface 345 of the eccentric cam 344 is engageable with a roller 346 secured to an end of a rod 350. The other end of the rod 350 extends through a hole 354 formed through a vertical wall 352. The rod 350 includes a small-diameter portion extending from the other end thereof, and a cap 356 is fixed to a free end of the small-diameter portion of the rod 350. A retainer 358 is fixed to the vertical wall 352, and a spring 360 is provided between the retainer 358 and a stepped surface of the rod 350. The spring 360 biases the rod 350 in a direction to engage the roller 346 with the cam surface 345 of the eccentric cam 344.

A mounting plate 362 is fixed to the vertical wall 352, and an electromagnetic device in the form of a solenoid 364, serving as holding means, is supported by the mounting plate 362. An engagement member 366, serving as a reciprocated member, and formed of a magnetic material is provided adjacent to the solenoid 364. One end of the engagement member 366 is pivotally supported by the mounting plate 362, and the engagement member 366 as a whole is biased toward the solenoid 364 by a tension coil spring 368. The other end of the engagement member 366 is in engagement with the cap 356 fixed to the rod 350. When the eccentric cam 344 is rotated and the rod 350 is reciprocated in the axial direction thereof, the engagement member 366 comes near to, and backs away from, the solenoid 364. When a sensor (not shown) identifies that the engagement member 366 comes to the position nearest to the solenoid 364, a control device (not shown) supplies an exciting current to the solenoid 364 to magnetize the solenoid 364 and thereby attract the engagement member 366 thereto. In this state, the rod 350 is prevented from being advanced toward the eccentric cam 344 by the biasing force of the spring 360. Consequently, the roller 346 is held at a position spaced apart from the cam surface 345 of the eccentric cam 344. The cam surface 345 is formed such that as the engagement member 366 approaches the solenoid 364 the rate of approach of the engagement member 366 decreases, like the cam surface 45 in the first embodiment. The eccentric cam 344, roller 346, spring 360, rod 350, and cap 356 cooperate with each other to serve as displacing means.

In the second embodiment, the eccentric cam 344 serves as means for decreasing the rate of approach of the engagement member 366, and the sensor and control device (not shown) serves as means for controlling the operation of the solenoid 364.

A third link 370 extends from a middle portion of the second link 342, in a direction generally parallel to the needle-bar lever 338, so as to connect between the second link 342 and the roller 346. When the eccentric cam 344 is rotated, the third link 370 exerts a force to the second link 342 in a direction generally perpendicular thereto, so that the slider 322 is displaced on the slide shaft 320. Consequently, the ratio of a distance A, between the slider 322 and the second axis member 317 to a distance, B, between the rocker 316 and the second axis member 317 (hereinafter, referred to as the "lever ratio A/B) is changed.

In the third embodiment, the cam surface 345 of the eccentric cam 344 is adapted such that, when the lever 318 is pivoted clockwise, the second link 342 is displaced rightward as viewed in FIG. 10 and consequently the slider 322 is displaced toward the second axis member 317. Therefore, the lever ratio A/B is reduced, meaning that a ratio of the pivotal movement amount of the needle-bar lever 338 to that of the lever 318 is reduced.

Meanwhile, when the lever 318 is pivoted counterclockwise, the second link 342 is displaced leftward as viewed in FIG. 10 and consequently the slider 322 is displaced toward a free end of the slide shaft 320. Thus, the lever ratio A/B is increased, meaning that the ratio of the pivotal movement amount of the needle-bar lever 338 to that of the lever 318 is increased.

A light-activated switch (not shown) similar to the switch 182 employed in the first embodiment (FIG. 2) is provided in the arm 302, and a reflection area similar to the area 186 of the first embodiment is formed on the second wheel 310. The light-activated switch detects the reflection area on the second wheel 310, just at the time when the lever 318 is pivoted clockwise by a maximum amount due to the rotation of the second wheel 310, and generates to a control device (not shown) a detection signal indicating that the switch has detected the reflection area.

The operation of the needle-bar driving device constructed as described above will be described. In the normal sewing mode, no exciting current is applied to the solenoid 364. When the eccentric cam 344 is rotated, the roller 346 is displaced on the cam surface 345 of the eccentric cam 344, so that the rod 350 and third link 370 are displaced in the axial direction thereof. Meanwhile, when the main motor 304 is operated, the rocker 316 is pivoted and the slide shaft 320 of the lever 318 is pivoted. The pivotal movement of the slide shaft 320 is transmitted to the needle-bar lever 338 via the second link 342, so that the needle-bar lever 338 is pivoted about the needle-bar shaft 340. Consequently, the first link 336 and sleeve 334 are vertically reciprocated, so that the needle bar 332 is vertically oscillated. As the lever 318 is pivoted clockwise, that is, as the needle bar 332 is moved upward, the lever ratio A/B is reduced. On the contrary, as the lever 318 is pivoted counterclockwise, that is, as the needle bar 332 is moved downward, the lever ratio A/B is increased. Thus, the distance of movement of the needle bar 332 between an intermediate position thereof where the needle-bar lever 338 extends horizontally and the lower dead position thereof (hereinafter, referred to as the "lower-half amplitude"), is greater than the distance of movement of the needle bar 332 between the intermediate position thereof and the upper dead position thereof (hereinafter, referred to as the "upper-half amplitude"). In the normal sewing mode, therefore, the lower dead position of the needle bar 332 is established so that the sewing needle 330 sufficiently deeply penetrates a work cloth. Consequently, the vertical oscillation of the needle bar 332 results in forming stitches on the work cloth.

Meanwhile, in the skip stitching mode, the solenoid 364 is magnetized by the control device (not shown) when the needle bar 332 reaches the upper dead position thereof, so that the solenoid 364 attracts and holds the engagement member 366. When the needle bar 332 reaches the upper dead position thereof, the rod 350 is displaced rightward by a maximum amount as viewed in FIG. 10, so that the engagement member 366 comes nearest to the solenoid 364. In this situation, the solenoid 364 is magnetized. Therefore, the exciting current necessary for magnetizing the solenoid 364 and thereby attracting the engagement member 366 to the solenoid 364 is minimized. In addition, the noise of the impact of the engagement member 366 with the solenoid 364 is diminished. The lever 318, slider 322, second link 342, and needle-bar lever 338 cooperate with each other to serve as a dead-position changing mechanism. The cap 356, rod 350, third link 370, and second link 342 cooperate with each other to serve as a transmission mechanism. The second link 342, needle-bar lever 338 cooperate with each other to serve as a link mechanism. The second wheel 310, eccentric shaft 314, and rocker 316 cooperate with each other to serve as a crank mechanism.

With the engagement member 366 being attracted and held by the solenoid 364, the roller 346 is held at a position spaced apart from the cam surface 345 of the eccentric cam 344. In this state, the lever ratio A/B is not changed during the cycle time in which the needle bar 332 is oscillated once. That is, the ratio of the lower-half amplitude of the needle bar 332 to the upper-half amplitude thereof is not changed. Consequently, the full amplitude of the needle bar 332 is reduced as compared with that in the normal sewing mode, so that even when the needle bar 332 reaches the lower dead position thereof the sewing needle 330 does not penetrate the work cloth. Stated differently, in the skip stitching mode, no stitch is formed on the work cloth though the needle bar 332 is vertically oscillated.

When an operator operates an end switch (not shown) of the sewing machine to end the current sewing operation, the control device (not shown) is responsive to the supply thereto of a detection signal from the light-activated switch (not shown), to generate an end signal to a drive circuit (not shown) for the main motor 304 to stop the operation of the main motor 304. Thus, when the lever 318 is pivoted clockwise by the maximum amount as viewed in FIG. 10, that is, the needle bar 332 reaches the upper dead position thereof, the needle bar 332 is stopped. Since the upper dead position of the needle bar 332 is not changed between in the skip stitching mode and in the normal sewing mode, the needle bar 332 is always stopped at the same vertical height or level, i.e., upper dead position.

While the third embodiment relates to a single-head sewing machine, it is possible to apply this arrangement to a multi-head sewing machine. This is achieved by lengthening the needle-bar shaft 340, securing one or more additional needle-bar levers 338 to the needle-bar shaft 340, and connecting one or more needle bars 332 and one or more sewing needles 330 to the respective needle-bar levers 338.

Figure 11:
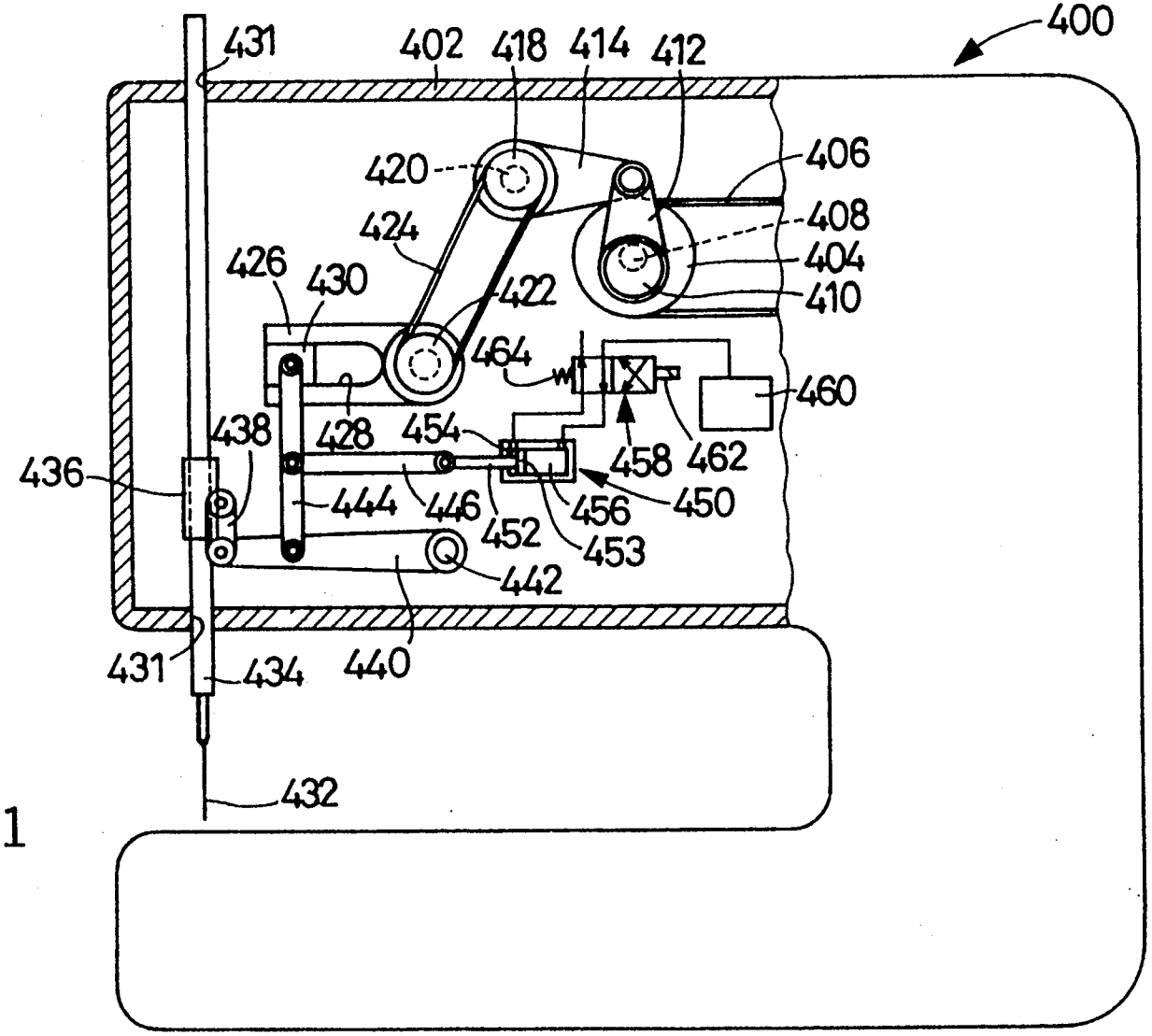
FIG. 11 is a front sectional view of a part of a sewing machine to which the fourth embodiment of the present invention is applied.

Referring next to FIG. 11, there is illustrated the fourth embodiment of the present invention.

In the fourth embodiment, a pulley 404 is rotatably supported by an arm 402 of a frame 400 of a sewing machine. A belt 406 is wound around the pulley 404, and the rotation of a main motor (not shown) is transmitted to the pulley 404 via the belt 406. The pulley 404 and a first axis member 408 are rotatable as a unit, and an eccentric shaft 410 is fixed to the first axis member 408. A rocker 412 is pivotally fitted at a base portion thereof around the eccentric shaft 410. A free end of the rocker 412 is connected to a free end of a lever 414.

A base portion of the lever 414 is fixed to a second axis member 420 which is rotatably supported by the arm 402 and with which a first synchronous pulley 418 is rotated as a unit. Consequently, the lever 414 and first synchronous pulley 418 are pivoted as a unit. Meanwhile, a second synchronous pulley 422 is rotatably supported by the arm 402. A toothed belt 424 is wound around, and between, the first and second synchronous pulleys 418, 422. Thus, the rotation of the pulley 404 is converted to the upward and downward movement of the rocker 412, which in turn is converted to the pivotal movement of the lever 414, which in turn is transmitted to the second synchronous pulley 422 via the first synchronous pulley 418 and the toothed belt 424.

A slide link 426 is secured to the second synchronous pulley 422 such that the slide link 426 and second synchronous pulley 422 are pivotable as a unit. The slide link 426 has an elongate recess 428 extending horizontally as viewed in FIG. 11. A slider 430 is slidably fitted in the recess 428 of the slide link 426.

The arm 402 has an upper and a lower guide hole 431 formed to be coaxial with each other. A needle bar 434 supporting at a lower end thereof a sewing needle 432, extends through the two guide holes 431 in such a manner that the needle bar 434 can vertically be oscillated. A first link 438 is connected to a middle portion of the needle bar 434 via a sleeve 436. A needle-bar lever 440 is connected at one end thereof to the first link 438. The needle-bar lever 440 is pivotally supported at the other end thereof by a needle-bar shaft 442 which is pivotally secured to the arm 402. The needle-bar lever 440 and the slider 430 are connected to each other by a second link 444 extending generally parallel to the slide link 426.

A third link 446 is connected to a middle portion of the second link 444. The third link 446 extends generally parallel to the slide link 426 and needle-bar lever 440. A piston rod 452 is connected at one end thereof to the third link 446. A piston head 453 is fixed to the other end of the piston rod 452. The piston head 453 is slidable inside an air cylinder 450 fixed to the arm 402. The air cylinder 450 is divided by the piston head 453 into a first and a second air chamber 454, 456 which communicate with an air supplying device 460 via an electromagnetic selector valve 458. The selector valve 458 includes a solenoid 462 and a spring 464. When no exciting current is applied to the solenoid 462, the spring 464 biases the selector valve 458 in a direction to communicate the first air chamber 454 with ambient air and communicate the second air chamber 456 with the air supplying device 460. In this state, the piston rod 452 is in an advanced position thereof as a result of a leftward movement thereof as viewed in FIG. 11. Meanwhile, upon application of an exciting current to the solenoid 462, the selector valve 458 is changed to communicate the first air chamber 454 with the air supplying device 460 and communicate the second air chamber 456 with the ambient air. Thus, the piston rod 452 is displaced to a retracted position thereof as a result of a rightward movement thereof as viewed in FIG. 11.

A light-activated switch (not shown) similar to the switch 182 used in the first embodiment (FIG. 2) is provided in the arm 402, and is connected to a control device (not shown). A reflection area similar to the area 186 of the first embodiment is formed on the slide link 426. The light-activated switch detects the reflection area on the slide link 426, just at the time when the slide link 426 is pivoted clockwise by a maximum amount together with the rotation of the second synchronous pulley 422, and generates to the control device a detection signal indicating that the switch has detected the reflection area.

The operation of the needle-bar driving device constructed as described above will be described hereinafter. In the normal sewing mode, no exciting current is applied to the solenoid 462, so that the second link 444 is subjected to a leftward force from the piston rod 452 via the third link 446. Consequently, the slider 430 is displaced leftward toward a free end of the slide link 426. In this state, when the main motor (not shown) is operated and the pulley 404 is rotated, the slide link 426 and second synchronous pulley 422 are pivoted as a result of respective operations of the rocker 412, lever 414, first synchronous pulley 418, and toothed belt 424. The pivotal movement of the slide link 426 is transmitted to the needle-bar lever 440 via the slider 430 and the second link 444, so that the needle-bar lever 440 is pivoted about the needle-bar shaft 442. Consequently, the needle bar 434 is vertically oscillated. Since the slider 430 is positioned at the tip of the slide link 426, the ratio of the amount of pivotal movement of the needle-bar lever 440 to that of the slide link 426 is great, and accordingly the full amplitude of the needle bar 434 is great. In the normal sewing mode, therefore, the lower dead position of the needle bar 434 is defined so that the sewing needle 432 sufficiently deeply penetrates a work cloth. Thus, the vertical oscillation of the needle bar 434 results in forming stitches on the work cloth.

Meanwhile, in the skip stitching mode, the control device (not shown) continues to supply an exciting current to the solenoid 364 so as to magnetize the solenoid 462. Consequently, the slider 430 is displaced toward the second synchronous pulley 422. In this state, the slide link 426 is pivoted in the same manner as that in the normal sewing mode. However, in the skip stitching mode, the ratio of the amount of pivotal movement of the needle-bar lever 440 to that of the slide link 426 is smaller than that in the normal sewing mode. Consequently, the lower dead position of the needle bar 434 is changed to a higher position, while the upper dead position of the needle bar 434 is changed to a lower position. Accordingly the full amplitude of the needle bar 434 is reduced as compared with that in the normal sewing mode. Thus, even when the needle bar 434 reaches the lower dead position thereof, the sewing needle 432 does not penetrate the work cloth. Stated differently, when the sewing machine is in the skip stitching mode, no stitch is formed on the work cloth though the needle bar 434 is vertically oscillated. The slide link 426, slider 430, second link 444, third link 446, and needle-bar lever 440 cooperate with each other to serve as a dead-position changing mechanism.

When an operator operates an end switch (not shown) of the sewing machine to stop the current sewing operation, the control device (not shown) is responsive to the supply thereto of a detection signal from the light-activated switch (not shown), to cease supplying the exciting current to the solenoid 462 and thereby cause the slider 430 to be displaced to the tip of the slide link 426. In addition, the control device generates an end signal to the main motor (not shown) to stop the operation (i.e., rotation) of the main motor and thereby stop the needle bar 434 at the upper dead position. Thus, the upper dead position of the needle bar 434 is not changed between in the skip stitching mode and the normal sewing mode.

In the fourth embodiment, the needle-bar driving device may be adapted such that, in the skip stitching mode, the solenoid 462 be magnetized to retract the piston rod 452 during the downward movement of the needle bar 434, and be demagnetized to advance the piston rod 452 during the upward movement of the needle bar 434. In this arrangement, the upper dead position of the needle bar 434 is not changed and only the lower dead position of the needle bar 434 is changed to a higher position.

While the fourth embodiment relates to a single-head sewing machine, it is possible to apply this arrangement to a multi-head sewing machine. This is achieved by lengthening the needle-bar shaft 442, securing one or more additional needle-bar levers 440 to the needle-bar shaft 442, and connecting one or more needle bars 434 and one or more sewing needles 432 to the respective needle-bar levers 440.

Figure 12:
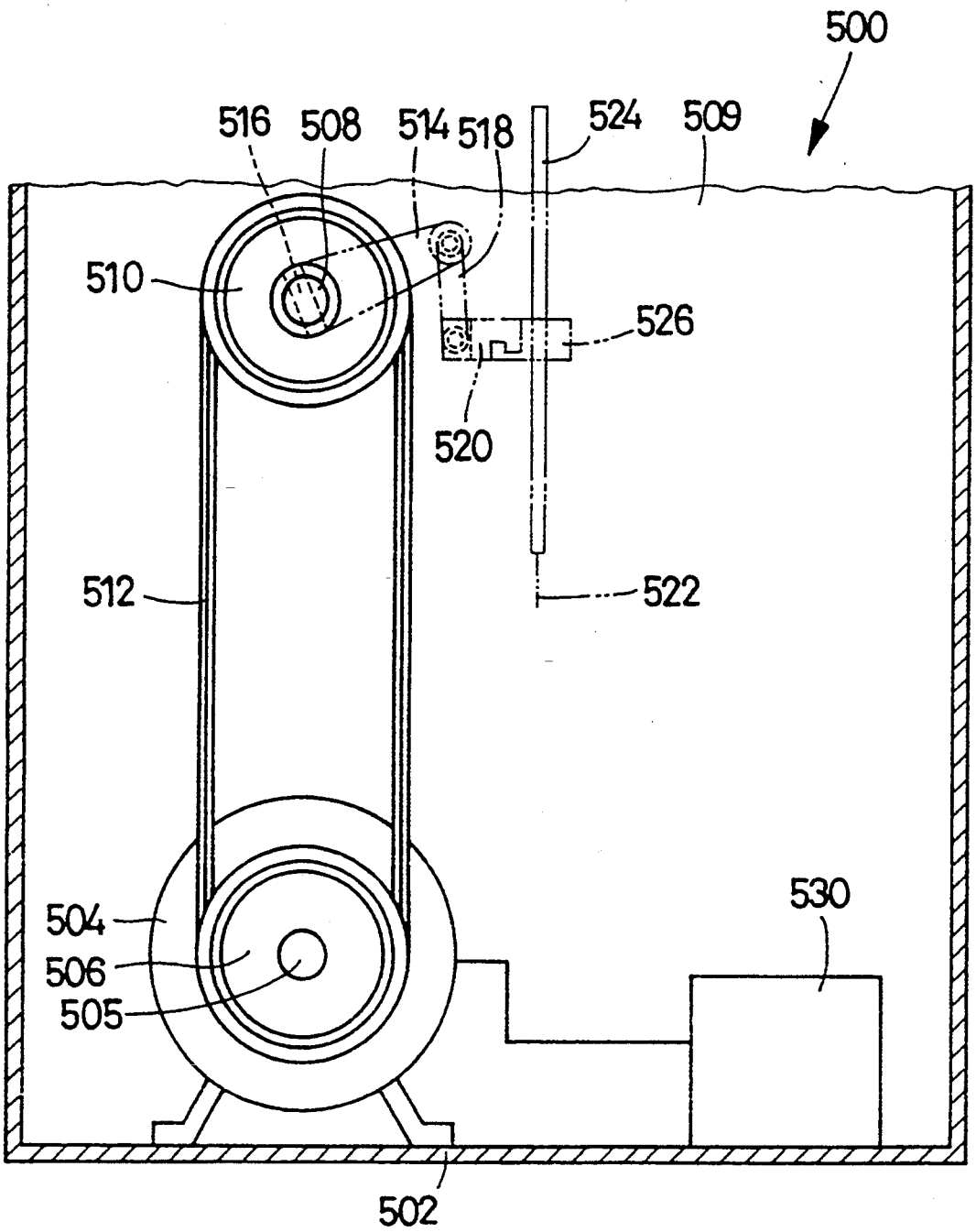
FIG. 12 is a front sectional view of a part of a needle-bar driving device as the fifth embodiment of the present invention.

Referring next to FIG. 12, there is illustrated the fifth embodiment of the present invention.

A main motor 504 is fixed to a column 502 of a frame 500 of a sewing machine. The main motor 504 is rotatable in both a positive direction and a negative or reverse direction opposite to the positive direction. The main motor 504 has an output shaft 505 to which a first pulley 506 is secured such that the first pulley 506 is not rotatable relative to the output shaft 505. Above the main motor 504, a needle-bar shaft 508 is rotatably supported by a boss provided on a partition wall 509. A second pulley 510 is secured to the needle-bar shaft 510 such that the second pulley 510 is not rotatable relative to the needle-bar shaft 510. A belt 512 is wound around, and between, the first and second pulleys 506, 510, so that the rotation of the main motor 504 is transmitted to the needle-bar shaft 508.

The needle-bar shaft 508 extends into an arm (not shown) of the frame 500. In the arm, a lever 514 is secured to the needle-bar shaft 508 with a spring pin 516, such that the lever 514 is not pivotable relative to the needle-bar shaft 508. A transmitter 520 is connected to a free end of the lever 514 via a link 518. In the arm .of the frame 500, are provided a needle bar case similar to the cases 100 used in the first embodiment (FIG. 1). A needle bar 524 supporting at a lower end thereof a sewing needle 522 is supported by the needle bar case, such that the needle bar 524 can vertically be oscillated. A spring (not shown) biases the needle bar 524 upward. An engagement member 526 is secured to the needle bar 524, and the transmitter 520 is in engagement with the engagement member 526.

The main motor 504 is connected to a rotation control device 530. An encoder (not shown) is provided on the output shaft 505 of the main motor 504, to measure the amount (i.e., angle) of rotation of the main motor 504 and determine the direction of the motor rotation. The encoder supplies detection signals indicative of the detected rotation angle and direction, to the rotation control device 530. The rotation control device 530 is responsive to the detection signals from the encoder, to generate a control signal to a drive circuit for the main motor 504 so as to control the rotation of the main motor 504.

In the normal sewing mode, the rotation control device 530 operates for rotating the main motor 504 by a greater angle than that in the skip stitching mode. Consequently, the needle bar 524 is oscillated by a greater amplitude, so that the vertical oscillation of the sewing needle 522 results in producing stitches on a work cloth. Meanwhile, in the skip stitching mode, the rotation control device 530 operates for rotating the main motor 504 by a smaller angle than that in the normal sewing mode, and thereby oscillating the needle bar 524 by a smaller amplitude. The lower dead position of the needle bar 524 is changed to a higher position where the sewing needle 522 cannot stick in the work cloth. Therefore, no stitch is formed on the work cloth. The upper dead position of the needle bar 524 is not changed. Both in the normal sewing mode and in the skip stitching mode, the needle bar 524 is stopped at the same vertical position, i.e., upper dead position, when the current sewing operation is ended on the present sewing machine.

In the fifth embodiment, the encoder (not shown) and the rotation control device 530 cooperate with each other to serve as stop control means for stopping the needle bar 524 at the upper dead position thereof.

In the fifth embodiment, the rotation control device 530 may be adapted such that, when the current sewing operation is ended, the main motor 504 is rotated by an increased angle so that the upper dead position of the needle bar 524 (or the highest position of the sewing needle 522) is changed to a predetermined position higher than that in the normal sewing or skip stitching mode. This arrangement permits the sewing operations to more quietly be carried out by employing smaller amplitudes of the needle bar 524, and permits a work cloth to be mounted in place more easily on the sewing machine.

In addition, it is possible to change, by an equal or common angle, the rotation angles of the main motor 504 in both the positive and reverse directions thereof, between in the normal sewing mode and in the skip stitching mode. In this case, both the upper and lower dead positions of the needle bar 524 are changed, either upward or downward, by an equal amount or distance. The full amplitude of the needle bar 524 is not changed, but the center (or origin) of oscillation of the needle bar 524 is changed. This arrangement of the needle-bar driving device enables the sewing machine to be placed in a marking mode in which the center of oscillation of the needle bar 524 is changed to a position higher than that in the normal sewing mode and lower than that in the skip stitching mode. When the needle bar 524 is vertically oscillated in the marking mode, only the tip of the sewing needle 522 repetitively sticks in the work cloth, thereby providing holes or marks in the work cloth. Since the center of oscillation of the needle bar 524 in the skip stitching mode is higher than that in the marking mode, the sewing needle 522 does not stick in the work cloth, though the needle bar 524 is vertically oscillated.

In the illustrated embodiments, it is preferred that a backup battery be provided in case the supply of electric current to the solenoid 160, 200, 364, 462 is ceased due to, for example, an instantaneous serve interruption during the excitation of the solenoid. In the first embodiment, for example, the backup battery serves for preventing the roller 176 from colliding with the eccentric cam 44, or preventing the rate or speed of oscillation of the needle bar 114, 116, 146, 148, 332, 434, 524 from being suddenly changed.

Figure 13:
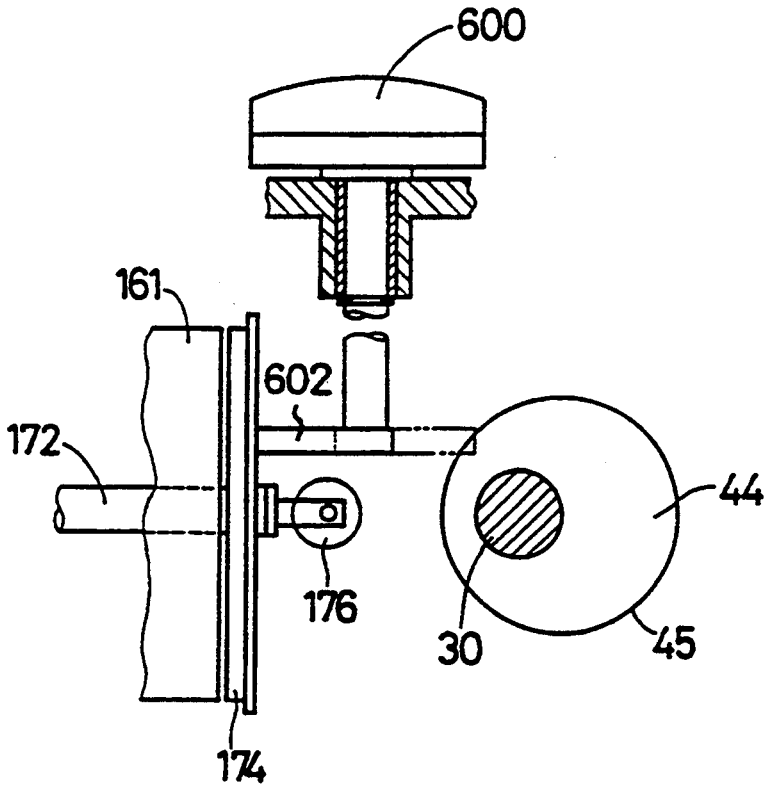
FIG. 13 is a front sectional view of a part of the needle-bar driving device of FIG. 1, in which a manually operable cam device 600 is used.

Regarding the first embodiment shown in FIG. 1, when the solenoid 160 is in the unexcited or non-magnetized state, the needle-bar driving device is in the state in which the sewing machine is ready to begin the skip stitching. Therefore, when the sewing machine is not in use and the solenoid 160 is in the non-magnetized state, it is impossible to adjust, for normal sewing, the lowest position of the sewing needle 118, 120, 142, 144 with respect to a shuttle of the sewing machine. However, this problem may be solved by providing an eccentric cam device 600, as shown in FIG. 13, which is manually operable for rotating an eccentric cam 602 to engage the disk 174 and thus, displace the disk 174 to the position nearest the yoke 161 of the solenoid 160, and thereby permitting the operator to manually move the needle-bar 114, 116, 146, 148 together with the corresponding needle 118, 120, 142, 144 to an adjusted lower dead position where the needle can carry out the normal sewing on a work cloth.

Figure 14:
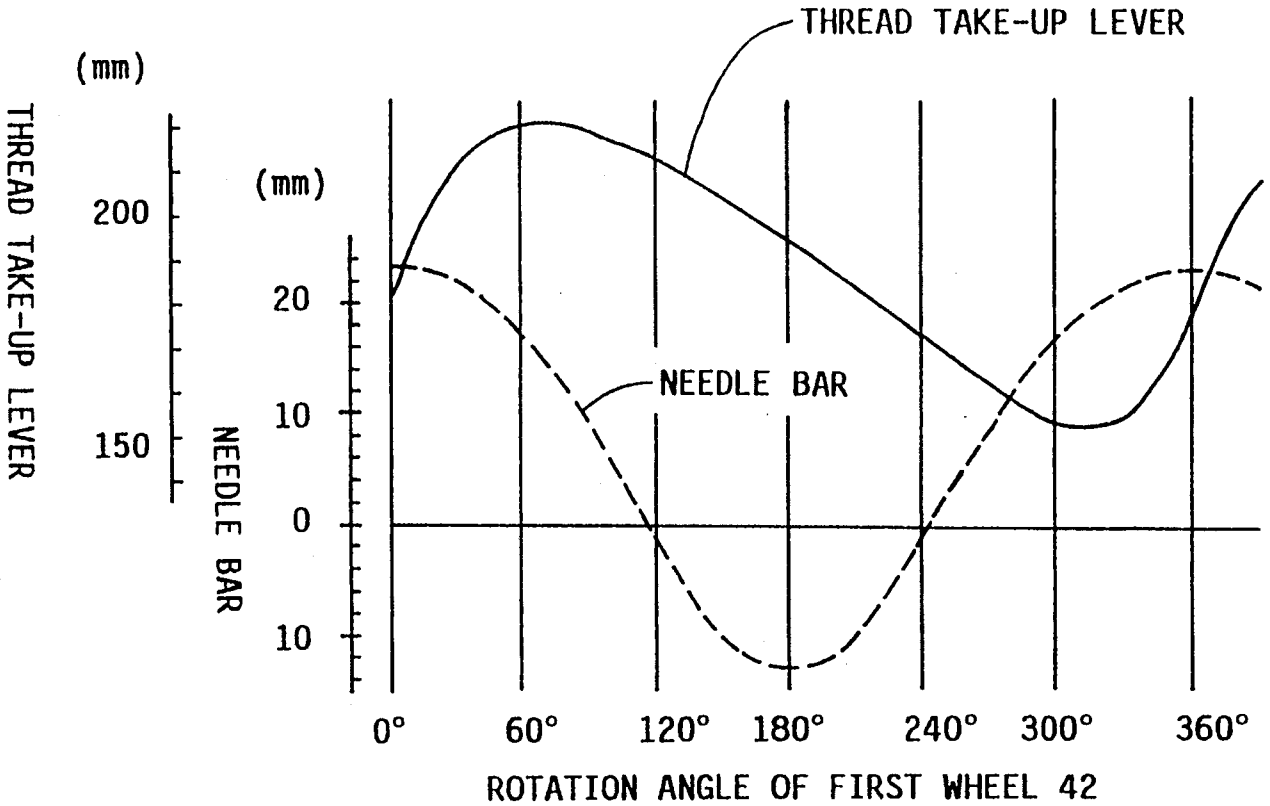
FIG. 14 is a graph showing the time-wise positional relationship between the needle bar and a thead take-up lever of the sewing machine to which the needle-bar driving device of FIG. 1 is applied.
Figure 15:
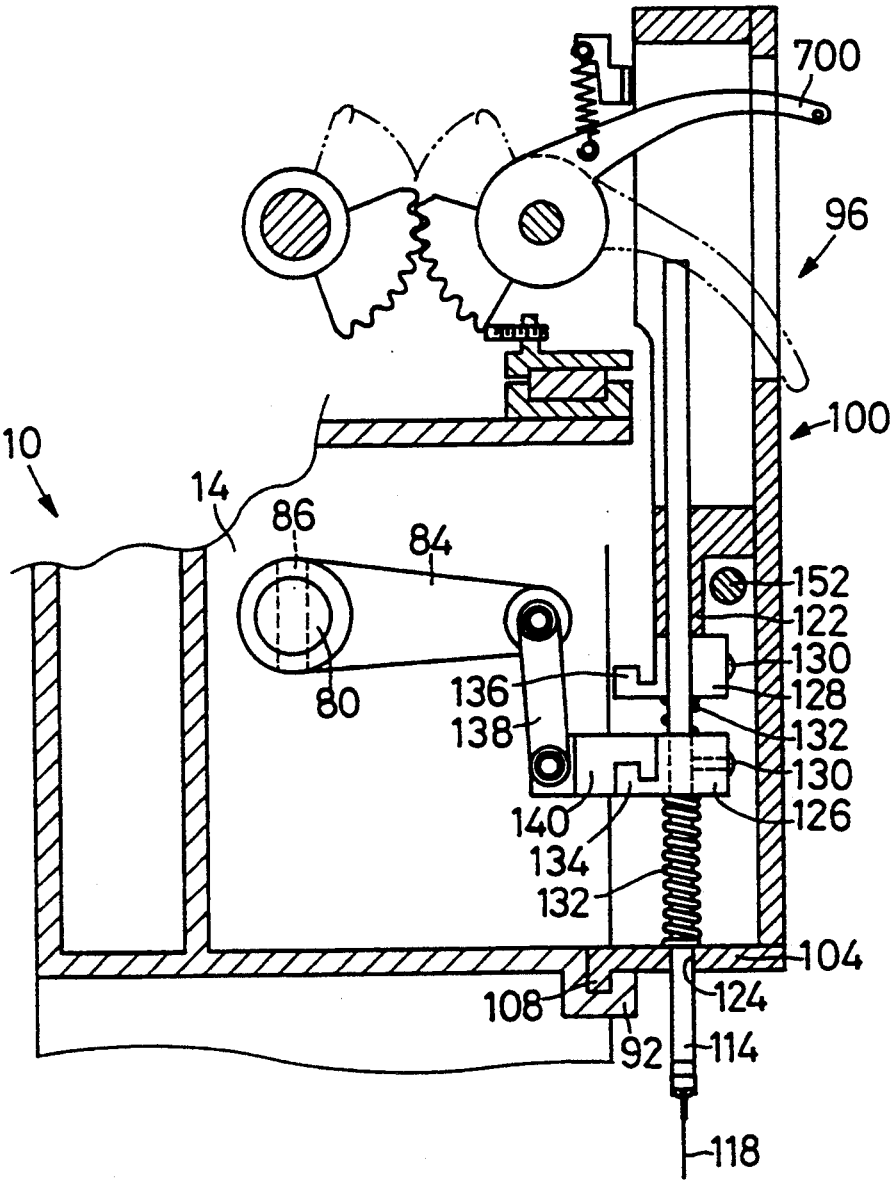
FIG. 15 is a view, corresponding to FIG. 5, of a modified form of the embodiment of FIG. 1.
Figure 16:
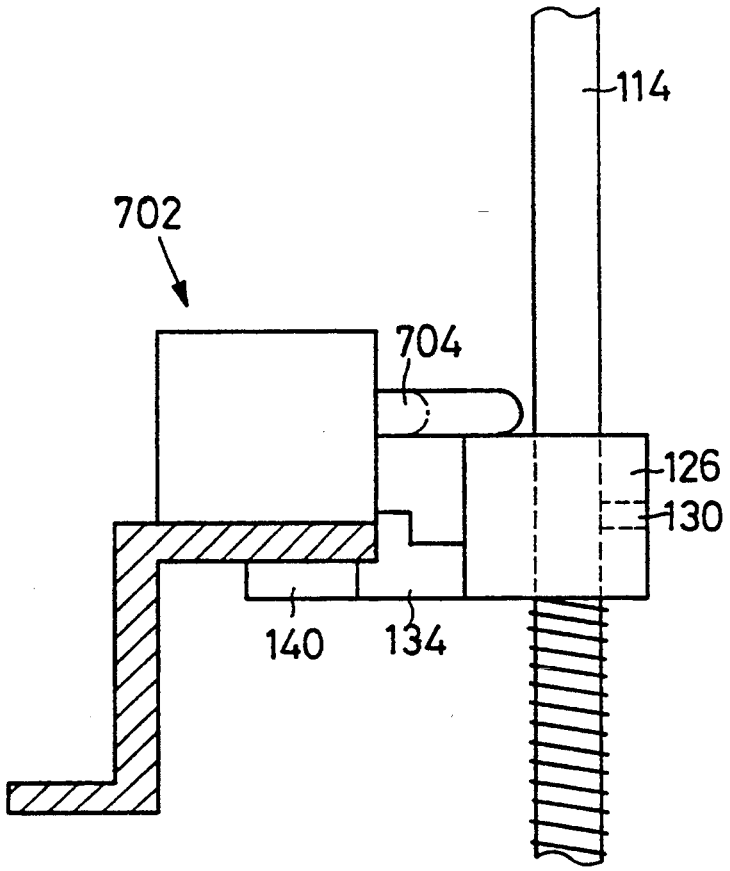
FIG. 16 is a view of a solenoid device of the modified form shown in FIG. 15.

Regarding the first embodiment shown in FIG. 1, the control device 184 may be adapted to, when the operator operates the end switch of the sewing machine, stop the main motor 22 and thus the needle-bar 114 at the time when a thread take-up lever 700 of the sewing machine reaches the upper dead position thereof, as illustrated in FIGS. 14, 15 and 16. Since the needle bar 114 and the thread take-up lever 700 are oscillated according to the time-wise or angle-wise positional relationship as shown in FIG. 14, the control device 184 utilizes the detection signal from the light-activated switch 182 for stopping the main motor 22 and the needle-bar 114 at that time. At the time, the control device 184 may apply an exciting current to a solenoid device 702 to advance a movable iron core 704 thereof to a position where the iron core 704 is engageable with the engagement member 126 on the needle bar 114 which has just been stopped. Unless the operator operates the end switch, the control device 184 applies no exciting current to the solenoid device 702, so that the iron core 704 remains at a retracted position thereof where the iron core 704 is not engageable with the engagement member 126 on the needle bar 114.

While the present invention has been described in its preferred embodiments, it is to be understood that the present invention may be embodied with other changes, improvements and modifications that may occur to those skilled in the art without departing from the scope and spirit of the invention defined in the appended claims.

What is claimed is:

1. A needle-bar driving device of a sewing machine, for oscillating a needle bar supporting at a lower end thereof a sewing needle, in the axial direction of the needle bar, comprising:

dead-position changing means for changing at least a lower dead position of said needle bar, wherein said dead-position changing means comprises amplitude reducing means for reducing an amplitude of the axial-direction oscillation of said needle bar, and thereby changing said lower dead position of the needle bar to a new lower dead position wherein said sewing needle cannot stock in a work piece; and electric control means for electrically controlling, while the needle-bar driving device oscillates said needle bar and said sewing needle, said amplitude reducing means to reduce said amplitude of said axial-direction oscillation of said needle bar and thereby change said lower dead position of said needle bar to said new lower dead position.

2. The needle-bar driving device according to claim 1, wherein said dead-position changing means changes each of an upper and lower said dead positions of said needle bar.

3. The needle-bar driving device according to claim 1, wherein said amplitude reducing means comprises:

a reciprocative member which is reciprocated in synchronism with the axial-direction oscillation of said needle bar;

holding means for holding said reciprocative member when the reciprocative member is displaced to a predetermined position; and a dead-position changing mechanism for changing said lower dead position of said needle bar, according to a first state of said holding means in which the holding means holds the reciprocative member and a second state of the holding means in which the holding means does not hold the reciprocative member.

4. The needle-bar driving device according to claim 3, wherein said amplitude reducing means further comprises displacing means for displacing said reciprocative member to come near to, and back away from, said holding means, in synchronism with said axial direction oscillation of said needle bar.

5. The needle-bar driving device according to claim 4, wherein said displacing means comprises:

a cam having a cam surface, said cam being rotated in synchronism with said axial-direction oscillation of said needle bar;

a cam follower;

a biasing means for biasing said cam follower against said cam surface of said cam; and a transmission mechanism for transmitting movement of said cam follower to said reciprocative member.

6. The needle-bar driving device according to claim 3, wherein said holding means comprises an electromagnetic device for attracting and holding, by a magnetic force, said reciprocative member which is formed of a magnetic material and which is movable relative to said electromagnetic device to come near to, and back away from, the electromagnetic device, said electric control means electrically exciting said electromagnetic device to produce said magnetic force when said reciprocative member comes nearest to the electromagnetic device.

7. The needle-bar driving device according to claim 6, wherein said electric control means comprises:

a detectable member which is displaced in synchronism with the reciprocation of said reciprocative member;

a detector for detecting said detectable member when said reciprocative member comes nearest to said electromagnetic device, and generating a detection signal indicating that the reciprocative member has come nearest to the electromagnetic device; and exciting means responsive to said detection signal, for electrically exciting said electromagnetic device to produce said magnetic force.

8. The needle-bar driving device according to claim 3, wherein said holding means comprises:

a pawl which is engageable with said reciprocative member to hold the reciprocative member; and an electromagnetic device which displaces said pawl to an operative position thereof in which the pawl is engageable with said reciprocative member and to a retracted position thereof in which the pawl is not engageable with the reciprocative member.

9. The needle-bar driving device according to claim 3, further comprising a manually operable member which is displaceable by an operator to an operative position thereof in which said manually operable member holds said reciprocative member at substantially a same position as a position where the reciprocative member is held by said holding means, and to an inoperative position thereof in which the manually operable member permits the reciprocative member to freely be displaced.

10. The needle-bar driving device according to claim 3, wherein said dead-position changing means comprises:

a rotatable member which is rotatable about an axis line;

a slidable member mounted on said rotatable member such that said slidable member is rotatable about said axis line when said rotatable member is rotated about the axis line and that the slidable member is slidable in a direction in which the slidable member comes near to, and backs away from, said axis line and therefore a radius of the rotation of the slidable member is changed;

a transmission mechanism for transmitting the reciprocation of said reciprocative member to said slidable member; and a link mechanism for transmitting the rotation of said slidable member to said needle bar.

11. The needle-bar driving device according to claim 10, further comprising:

a needle-bar driving motor; and a crank mechanism for converting rotation of said driving motor to reciprocation, said rotatable member comprising a bell-crank lever which is provided between said crank mechanism and said needle bar and which is swingable about said axis line, said bell-crank lever having two arms one of which is connected to said crank mechanism and the other of which is connected to said slidable member such that the slidable member is slidable along a longitudinal direction of the other arm.

12. The needle-bar driving device according to claim 1, wherein said dead-position changing means comprises:

a hydraulically operated cylinder device including a piston which is movable to a first and a second position thereof; and a dead-position changing mechanism for changing said at least one of said upper and lower dead positions, according to said first and second positions of said piston.

13. The needle-bar driving device according to claim 1, being driven by an electric motor which is rotatable in each of a positive direction and a reverse direction opposite to said positive direction and which is controllable with respect to an angle of the rotation in said each direction, wherein said amplitude reducing means comprises said electric motor, said electric control means electrically controlling, while the needle-bar driving device is driven by said electric motor, said electric motor to change said lower dead position of said needle bar by changing the angle of rotation of said electric motor in a corresponding one of said positive and reverse directions.

14. The needle-bar driving device for with a multi-head sewing machine having a plurality of sewing heads, each of said plurality of sewing heads including at least one needle bar which supports at a lower end thereof a sewing needle, according to claim 1, the needle-bar driving device for oscillating each needle bar in an axial direction thereof wherein said amplitude reducing means of the needle-bar driving device comprises common amplitude reducing means for changing the lower dead position of each of said at least one needle bar of each of said sewing heads together with each other.

15. The needle-bar driving device according to claim 1, further comprising stop control means for stopping said needle bar at substantially a predetermined position, irrespective of whether said amplitude reducing means has changed said lower dead position of said needle bar.

16. The needle-bar driving device according to claim 15, wherein said stop control means stops said needle bar at an upper dead position thereof as said predetermined position.

17. The needle-bar driving device according to claim 1, said control means further comprising stop control means for stopping said needle bar at a predetermined position, said stop control means comprising a switch, wherein the sewing machine has a thread take-up lever which takes up a thread supplied to said sewing needle and said stop control means stops said needle bar at said predetermined position, irrespective of whether said amplitude reducing means has changed said lower dead position of said needle bar, when said switch detects when the thread take-up lever reaches an upper dead position thereof.

18. The needle-bar driving device, for use with a multi-head sewing machine having a plurality of sewing heads, each of said plurality of sewing heads including at least one needle bar which supports at a lower end thereof a sewing needle, according to claim 1, the needle-bar driving device for oscillating each said needle bar in an axial direction thereof wherein said dead-position changing means of the needle-bar driving device comprises common dead-position changing means for changing the lower dead position of each of said at least one needle bar of each of said sewing heads together with each other.

19. A needle-bar driving device of a sewing machine, for oscillating a needle bar supporting at a lower end thereof a sewing needle, in the axial direction of the needle bar, the driving device comprising dead-position changing means for changing at least one of an upper and a lower dead position of said needle bar, said dead-position changing means comprising a reciprocative member which is reciprocated in synchronism with the axial-direction oscillation of said needle bar; holding means for holding said reciprocative member when the reciprocative member is displaced to a predetermined position; and a dead-position changing mechanism for changing said at least one of said upper and lower dead positions of said needle bar, according to a first state of said holding means in which the holding means holds the reciprocative member and a second member of the holding means in which the holding means does not hold the reciprocative member.

20. The needle-bar driving device of claim 19, wherein said dead-position changing means further comprises displacing means for displacing said reciprocative member to come near to, and back away from, said holding means, in synchronism with said axial-direction oscillation of said needle bar.

21. The needle-bar driving device of claim 20, wherein said displacing means comprises:

a cam having a cam surface, said cam being rotated in synchronism with said axial-direction oscillation of said needle bar;

a cam follower;

a biasing means for biasing said cam follower against said cam surface of said cam; and a transmission mechanism for transmitting movement of said cam follower to said reciprocative member.

22. The needle-bar driving device of claim 19, wherein said holding means comprises an electromagnetic device for attracting and holding, by a magnetic force, said reciprocative member which is formed of a magnetic material and which is movable relative to said electromagnetic device to come near to, and back away from, the electromagnetic device, said electric control means electrically exciting said electromagnetic device to produce said magnetic force when said reciprocative member comes nearest to the electromagnetic device.

23. The needle-bar driving device of claim 22, wherein said electric control means comprises:

a detectable member which is displaced in synchronism with the reciprocation of said reciprocative member;

a detector for detecting said detectable member when said reciprocative member comes nearest to said electromagnetic device, and generating a detection signal indicating that the reciprocative member has come nearest to the electromagnetic device; and exciting means responsive to said detection signal, for electrically exciting said electromagnetic device to produce said magnetic force.

24. The needle-bar driving device of claim 19, further comprising a manually operable member which is displaceable by an operator to an operative position thereof in which said manually operable member holds said reciprocative member at substantially a same position as a position where the reciprocative member is held by said holding means, and to an inoperative position thereof in which the manually operable member permits the reciprocative member to freely be displaced.

25. The needle-bar driving device according to claim 19, wherein said holding means comprises:

a pawl which is engageable with said reciprocative member to hold the reciprocative member; and an electromagnetic device which displaces said pawl to an operative position thereof in which the pawl is engageable with said reciprocative member and to a retracted position thereof in which the pawl is not engageable with the reciprocative member.

26. The needle-bar driving device according to claim 19, wherein said dead-position changing mechanism comprises:

a rotatable member which is rotatable about an axis line;

a slidable member mounted on said rotatable member such that said slidable member is rotatable about said axis line when said rotatable member is rotated about the axis line and that the slidable member is slidable in a direction in which the slidable member comes near to, and backs away from, said axis line and therefore a radius of the rotation of the slidable member is changed;

a transmission mechanism for transmitting the reciprocation of said reciprocative member to said slidable member; and a link mechanism for transmitting the rotation of said slidable member to said needle bar.

27. A needle-bar driving device of a sewing machine, for oscillating a needle bar supporting at a lower end thereof a sewing needle, in the axial direction of the needle bar, comprising:

dead-position changing means for changing a lower dead position of said needle bar, wherein said dead-position changing means does not change an upper dead position of the needle bar; and electric control means for electrically controlling, while the needle-bar driving device oscillates said needle bar and said sewing needle, said dead-position changing means to change said lower dead position of said needle bar.

28. The needle-bar driving device according to claim 27, wherein said dead-position changing means comprises:

a reciprocative member which is reciprocated in synchronism with the axial-direction oscillation of said needle bar;

holding means for holding said reciprocative member when the reciprocative member is displaced to a predetermined position; and a dead-position changing mechanism for changing said lower dead position of said needle bar, according to a first state of said holding means in which the holding means holds the reciprocative member and a second state of the holding means in which the holding means does not hold the reciprocative member.

29. The needle-bar driving device according to claim 27, wherein said dead-position changing means comprises:

a hydraulically operated cylinder device including a piston which is movable to a first and a second position thereof; and a dead-position changing mechanism for changing said lower dead position according to said first and second positions of said piston.

30. The needle-bar driving device according to claim 27, being driven by an electric motor which is rotatable in each of a positive direction and a reverse direction opposite to said positive direction and which is controllable with respect to an angle of the rotation in said each direction, wherein said dead-position changing means comprises said electric motor, said electric control means electrically controlling, while the needle-bar driving device is driven by said electric motor, said electric motor to change said lower dead position of said needle bar by changing the angle of rotation of said electric motor in a corresponding one of said positive and reverse directions.

31. The needle-bar driving device according to claim 27, further comprising stop control means for stopping said needle bar at substantially a predetermined position, irrespective of whether said dead-position changing means has changed said lower dead position of said needle bar.

32. The needle-bar driving device according to claim 31, wherein said stop control means stops said needle bar at said upper dead position thereof as said predetermined position.

33. The needle-bar device according to claim 27, said electric control means further comprising stop control means for stopping said needle bar at a predetermined position, said stop control means comprising a switch, wherein the sewing machine has a thread take-up lever which takes up a thread supplied to said sewing needle and said stop control means stops said needle bar at said predetermined position, irrespective of whether said dead-position changing means has changed said lower dead position of said needle bar, when said switch detects when the thread take-up lever reaches said upper dead position thereof.

* * * * *